US010197243B2

(12) United States Patent
Dong et al.

(10) Patent No.: US 10,197,243 B2
(45) **Date of Patent: *Feb. 5, 2019**

(54) OPTICAL SIGNALING SYSTEM FOR A SMART-HOME DEVICE

(71) Applicant: Google LLC, Mountain View, CA (US)

(72) Inventors: William Dong, Palo Alto, CA (US); Adam Mittleman, Redwood City, CA (US); Bryan Macomber, Palo Alto, CA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/655,690

(22) Filed: Jul. 20, 2017

(65) Prior Publication Data

US 2018/0094792 A1 Apr. 5, 2018

Related U.S. Application Data

(63) Continuation of application No. 14/713,729, filed on May 15, 2015, now Pat. No. 9,746,154.

(51) Int. Cl.

| | |
|---|---|
| ***F21V 7/00*** | (2006.01) |
| ***F21V 7/04*** | (2006.01) |
| ***F21V 9/00*** | (2018.01) |
| ***F21V 29/83*** | (2015.01) |
| ***F21V 23/04*** | (2006.01) |
| ***G05G 1/10*** | (2006.01) |
| ***H01H 19/02*** | (2006.01) |
| ***F21V 33/00*** | (2006.01) |
| *G08B 17/10* | (2006.01) |
| *G08B 19/00* | (2006.01) |

(52) U.S. Cl.

CPC ..... *F21V 7/0008* (2013.01); *F21V 7/0058* (2013.01); *F21V 7/041* (2013.01); *F21V 9/00* (2013.01); *F21V 23/0442* (2013.01); *F21V 29/83* (2015.01); *F21V 33/0076* (2013.01); *G05G 1/105* (2013.01); *H01H 19/025* (2013.01); *G08B 17/10* (2013.01); *G08B 19/005* (2013.01)

(58) Field of Classification Search

CPC ..... F21V 7/0008; F21V 9/00; F21V 7/0033; F21V 7/0041; F21V 7/041; F21V 7/0058; G05G 1/105; H01H 19/025

USPC ..... 340/628

See application file for complete search history.

(56) References Cited

U.S. PATENT DOCUMENTS

| | | | |
|---|---|---|---|
| 5,642,933 | A | 7/1997 | Hitora |
| 6,565,223 | B2 | 5/2003 | Liao et al. |
| 6,965,205 | B2 | 11/2005 | Piepgras et al. |
| 8,016,421 | B2 | 9/2011 | Eberl et al. |
| 8,847,772 | B2 | 9/2014 | Marks et al. |

(Continued)

*Primary Examiner* — John A Tweel, Jr.

(74) *Attorney, Agent, or Firm* — Kilpatrick Townsend & Stockton LLP

(57) ABSTRACT

Various arrangements for light distribution incorporated as part of a device are presented. A circular light guide may be used that receives light from a plurality of light emitters that can be arranged in a circular pattern. A conical reflector may be used and may be positioned to reflect light emitted from the circular light guide onto an exterior of a case of the device. The conical reflector may reflect light such that light is reflected by the exterior of the case in the shape of a halo into an ambient environment of the device.

20 Claims, 18 Drawing Sheets

(56) References Cited

U.S. PATENT DOCUMENTS

| | | | | |
|---|---|---|---|---|
| 8,994,540 | B2 * | 3/2015 | Fadell | G08B 17/00 340/628 |
| 9,322,526 | B2 | 4/2016 | Liu et al. | |
| 9,746,154 | B2 * | 8/2017 | Dong | F21V 7/0008 |

* cited by examiner

OPTICAL SIGNALING SYSTEM FOR A SMART-HOME DEVICE

CROSS-REFERENCE TO RELATED APPLICATIONS

This application is a continuation of U.S. patent application Ser. No. 14/713,729, filed May 15, 2015, which is incorporated by reference herein.

BACKGROUND

1. The Field of the Invention

The present invention generally relates to light output. More specifically, the present invention relates to evening the light output by a sensor device that uses multiple lighting elements.

2. Background

Devices that output light, especially devices that use multiple light emitting diodes (LEDs), tend to output such light in an uneven fashion. That is, certain regions of an output apparatus tend to output more light and appear brighter to a user while other regions of the output apparatus tend to output less light and appear dimmer to the user. Such an effect may be found by users to be aesthetically poor.

SUMMARY

In some embodiments, a light distribution system for a sensor device is presented. The system may include a circular light guide that receives light from a plurality of light emitters arranged in a circular pattern. The system may include a conical reflector positioned to reflect light emitted from the circular light guide onto an exterior of a case of the sensor device, the conical reflector reflecting light such that light is reflected by the exterior of the case into an ambient environment of the sensor device when each light source of the plurality of light emitters are illuminated.

In various embodiments, one or more of the following features may be preset in such a system: The system may include a plurality of arched light diffusers and a plurality of light receptacles, wherein the plurality of light receptacles receive light from the plurality of light emitters, and the plurality of arched light diffusers are interspersed with the plurality of light receptacles. The light that is reflected by the exterior of the case into the ambient environment of the sensor device may be reflected in a halo pattern. The conical reflector may be part of a button that can be actuated by a user and the conical reflector may be hidden when the sensor device is viewed from the top. The system may include the case, wherein the light that is reflected by the exterior of the case into the ambient environment of the sensor device is reflected by a circular depressed region of the exterior of the case. The case may include a grille that permits airflow into the sensor device, and the circular light guide and the conical reflector are positioned such that light encircles a center point of the grille. The circular depressed region of the exterior of the case may include a first region of greater material thickness and a second region of lesser material thickness. The second region of lesser material thickness may be positioned proximate to a status light such that the status light, when illuminated, shines light through the second region of lesser material thickness into the ambient environment of the sensor device. The system may include the plurality of light emitters, the plurality of light emitters comprising five or more groups of light emitting diodes (LEDs). Each group of LEDs may include a red LED, a blue LED, and a green LED. The circular light guide may include a plurality of light receptacles, wherein each group of LEDs is positioned to emit light into a particular light receptacle of the plurality of light receptacles. The plurality of light receptacles may each include a parabolic surface through which light is received by the circular light guide. The conical reflector may include at least a portion having a right circular conical section shape. The circular light guide may include a transparent plastic portion and a titanium dioxide reflective cladding. The system may include a plurality of arc insulators that are attached to the plurality of arched light diffusers to prevent light from entering an interior space of the sensor device through the plurality of arched light diffusers. A surface of the circular light guide through light is emitted to the conical reflector may have a textured surface to diffuse light.

In some embodiments, a device comprising a light distribution system is presented. The device may include a case; a carbon monoxide sensor within the case; a smoke sensor within the case; a plurality of light emitting diodes (LEDs) within the case; one or more processors in communication with the carbon monoxide sensor, the smoke sensor, and the plurality of LEDs. The one or more processors may control illumination of the plurality of LEDs based on information from the carbon monoxide sensor and the smoke sensor. The device may also include a circular light guide that receives light from a plurality of light emitters arranged in a circular pattern. The device may also include a conical reflector positioned to reflect light emitted from the circular light guide onto an exterior of the case of the device, the conical reflector reflecting light such that light is reflected by the exterior of the case into an ambient environment of the device when each light source of the plurality of light emitters are illuminated.

In some embodiments, a light distribution apparatus is presented. The apparatus may include a casing means. The apparatus may include a circular guide means that receives light from a plurality of light emitters arranged in a circular pattern. The apparatus may include a conical reflector means positioned to reflect light emitted from the circular guide means onto an exterior of the casing means of the light distribution apparatus within which the light distribution apparatus is at least partially housed. The conical reflector means may reflect light such that light is reflected by the exterior of the casing means into an ambient environment of the light distribution apparatus when each light source of the plurality of light emitters are illuminated. The apparatus may include arched light diffuser means that disperse light within the circular guide means incident on the arched light diffuser means. The casing means may include a first region of greater material thickness and a second region of lesser material thickness and the second region of lesser material thickness is positioned proximate to a light emitter such that the light emitter, when illuminated, shines light through the second region of lesser material thickness into the ambient environment of the light distribution apparatus.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
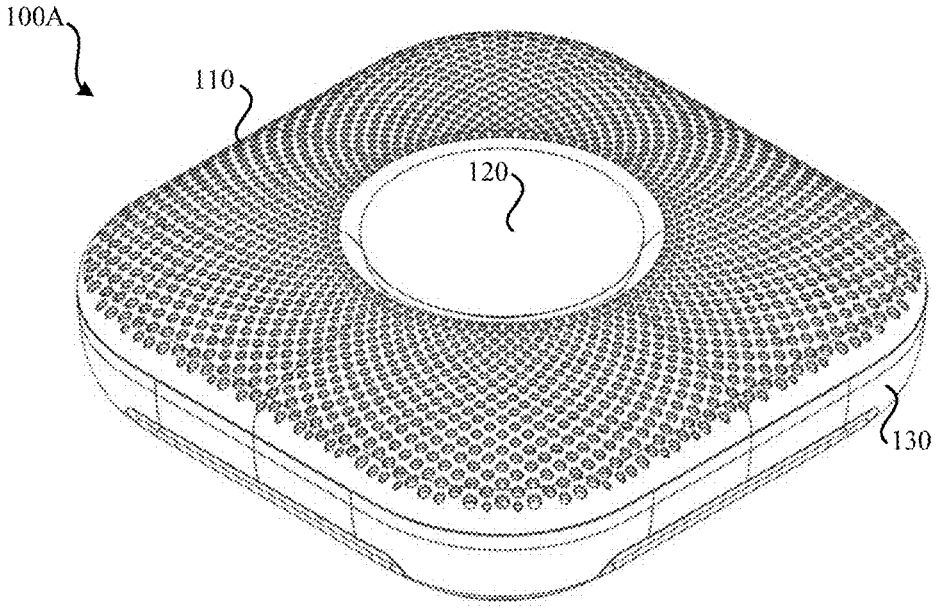
FIGS. 1A and 1B illustrate an embodiment of a smart combined smoke detector and carbon monoxide device.

Devices, such as sensor devices, may output light for multiple reasons, including to provide an indication of the device's state or other information to a nearby user and to provide lighting for illumination of the ambient environment. By using multiple lighting elements, such as light emitting diodes (LEDs), various effects can be realized, including: increased light output (brightness), lighting animations, and multiple colors. While using one or more lights on devices for outputting information and/or lighting has been known for a significant period of time, outputting such light in an aesthetically-pleasing manner into the ambient environment of the device has been difficult to realize. Typically, a lighting element, such as an LED, of a device may shine directly into the ambient environment of the device, creating a bright "pinpoint" of light. Such an effect may be aesthetically annoying to a user and potentially distracting when the user is trying to sleep or otherwise perform a task where light can be an impediment.

Arrangements presented herein are focused on light distribution systems for routing light from multiple lighting elements into the ambient environment of a sensor device to produce an even glow, such as in the shape of a halo. For instance, such sensor devices can include smoke detectors, carbon monoxide detectors, and combination smoke detector and carbon monoxide detectors. Other types of sensor devices may also use the light distribution systems presented herein, such as an alarm system, security system, home automation host system, humidity sensor, etc. Further, while this document focuses on the applications of such light distribution systems for sensor devices, it should be understood that the light distribution systems presented herein can be used for other types of devices besides sensor devices.

The light distribution systems presented herein are focused on distributing light from multiple lighting elements (e.g., LEDs) into the ambient environment of a sensor device. The light distribution systems may use a (circular) light guide and a reflector, which may have a portion that has a conical shape, to distribute light from the lighting elements into the ambient environment of the sensor device, such as for viewing by one or more users and/or for lighting the ambient environment (e.g., serving as a nightlight). Light from the lighting elements may be partially distributed using the circular light guide. At least some light exiting the circular light guide may be incident upon a conical reflector. The conical reflector, which may be geometrically shaped as a portion of a right circular cone, may reflect and further distribute the light generated by the multiple lighting elements. Light reflected by the conical reflector may then be incident upon an exterior of a case of the sensor device. This portion of the exterior surface of the case of the sensor device may be depressed towards an interior of the sensor device as compared to other portions of the case. The light reflecting off of the exterior of the case may then enter the ambient environment of the sensor device for viewing by a user and/or for lighting purposes. By using the light guide, and reflector, and leveraging the exterior of the case of the sensor device, the light may be distributed in such a manner that a typical user cannot perceive (or has difficulty perceiving) that the light originated from multiple, discrete lighting elements, but rather appears continuous. Further, such an arrangement may allow light to be output in a "halo" shape (a perimeter of a circle, the perimeter having approximately a constant width). Such an arrangement may result in a pleasing aesthetic view of the light emanating from the sensor device by a user.

Further, in some instances, it may be desired to output a status light by the sensor device while minimally impacting the aesthetics of the exterior of the sensor device. For instance, if a sensor device is receiving power from a wired source (e.g., a household's wired power distribution system), it may be desired for the sensor device to use light to indicate that such power is detected and being used by the sensor device. A thinned portion of the sensor device's exterior case may allow light to shine through the thinned portion when a lighting source within the case is illuminated. When the lighting source is not illuminated, the thinned portion of the case may appear substantially the same as any other portion (e.g., non-thinned portion) of the case. Therefore, when the lighting source is not illuminated, the thinned portion of the case that facilitates transmission of the light is effectively "invisible" to a user viewing the sensor device from the exterior.

Various embodiments of light distribution systems that help produce an even glow output, including the above aspects and aspects yet to be noted, are described in detail in relation to the figures that follow. For overall understanding, a big picture view of a device that can use such a light distribution system is presented. Such a device may be a dedicated smoke detector or a combination device, such as carbon-monoxide detector and smoke detector. FIG. 1A illustrates an embodiment of a smart combined smoke detector and carbon monoxide device 100A. Such an embodiment of a smart combined smoke detector and carbon monoxide device 100A may be suitable for mounting to a wall or ceiling in a room (or other location) within a structure in which smoke and/or carbon monoxide is to be monitored. Device 100A may be "smart," meaning the device 100A can communicate, likely wirelessly, with one or more other devices or networks. For instance, device 100A may communicate with a remote server via the Internet and, possibly, a home wireless network (e.g., an IEEE 802.11a/b/g network, 802.15 network, such as using the Zigbee® or Z-Wave® specification). Such a smart device may allow for a user to interact with the device via wireless communication, either via a direct or network connection between a computerized device (e.g., cellular phone, tablet computer, laptop computer, or desktop computer) and the smart device.

FIG. 1A illustrates an angular top projection view of combined smoke detector and carbon monoxide device 100A. Device 100A may generally be square or rectangular and have rounded corners. Visible in the angular top projection view are various components of the combined smoke detector and carbon monoxide device 100A, including: cover grille 110, lens/button 120, and enclosure 130 (also referred to as sensor housing 130). Cover grille 110 may serve to allow air to enter combined smoke detector and carbon monoxide device 100A through many holes while giving device 100A a pleasing aesthetic appearance. Cover grille 110 may further serve to reflect light into the external environment of device 100A from internal lighting elements (e.g., LEDs). Light may be routed internally to cover grille 110 by a light guide, noted in relation to FIGS. 2A, 2C, and 2D. It should be understood that the arrangement of holes and shape of cover grille 110 may be varied by embodiment. Lens/button 120 may serve multiple purposes. First, lens/button 120 may function as a lens, such as a Fresnel lens, for use by a sensor, such as an infrared (IR) sensor, located within device 100A behind lens/button 120 for viewing the external environment of device 100A. Additionally, lens/button 120 may be actuated by a user by pushing lens/button 120. Such actuation may serve as user input to device 100A. Enclosure 130 may serve as a housing for at least some of the components of device 100A.

Figure 1B:
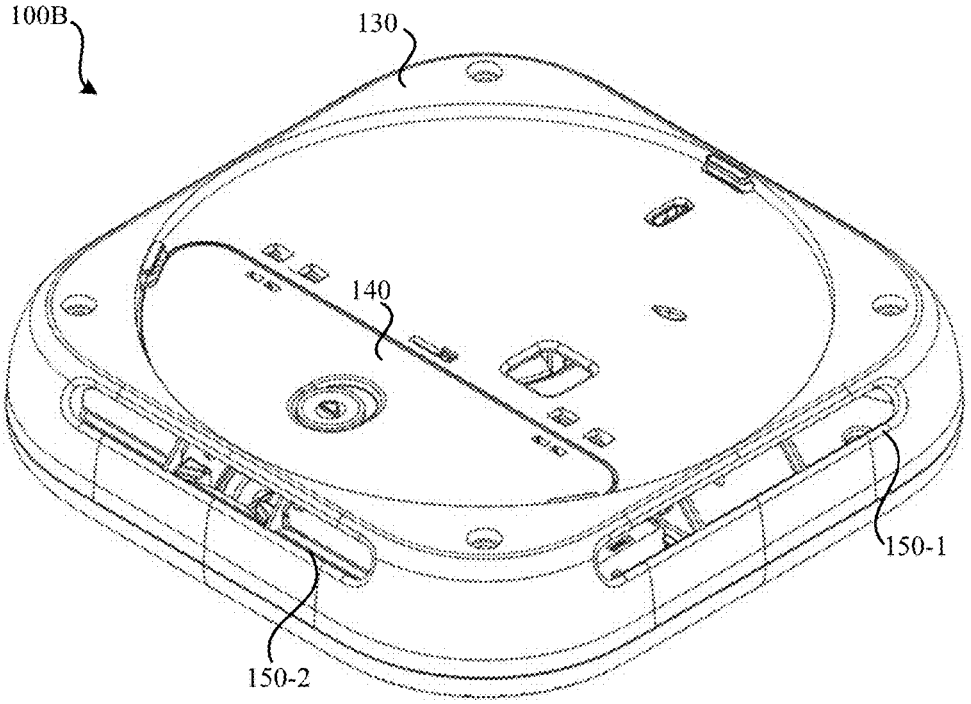

FIG. 1B illustrates an angular bottom projection view of a smart combined smoke detector and carbon monoxide device 100B. It should be understood that device 100A and device 100B may be the same device viewed from different angles. Visible from this view is a portion of enclosure 130. On enclosure 130, battery compartment door 140 is present through which a battery compartment is accessible. Also visible are airflow vents 150-1 and 150-2, which allow air to pass through enclosure 130 and enter the smoke chamber of device 100B.

Figure 2A:
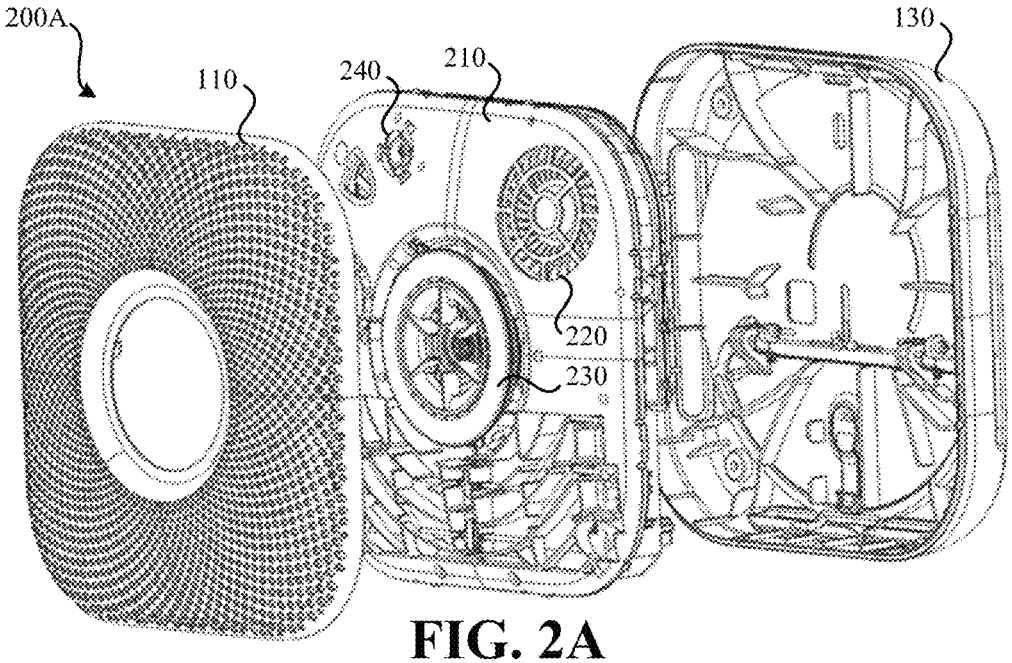
FIGS. 2A, 2B, 2C, and 2D illustrate an embodiment of an exploded smart combined smoke detector and carbon monoxide device.
Figure 2B:
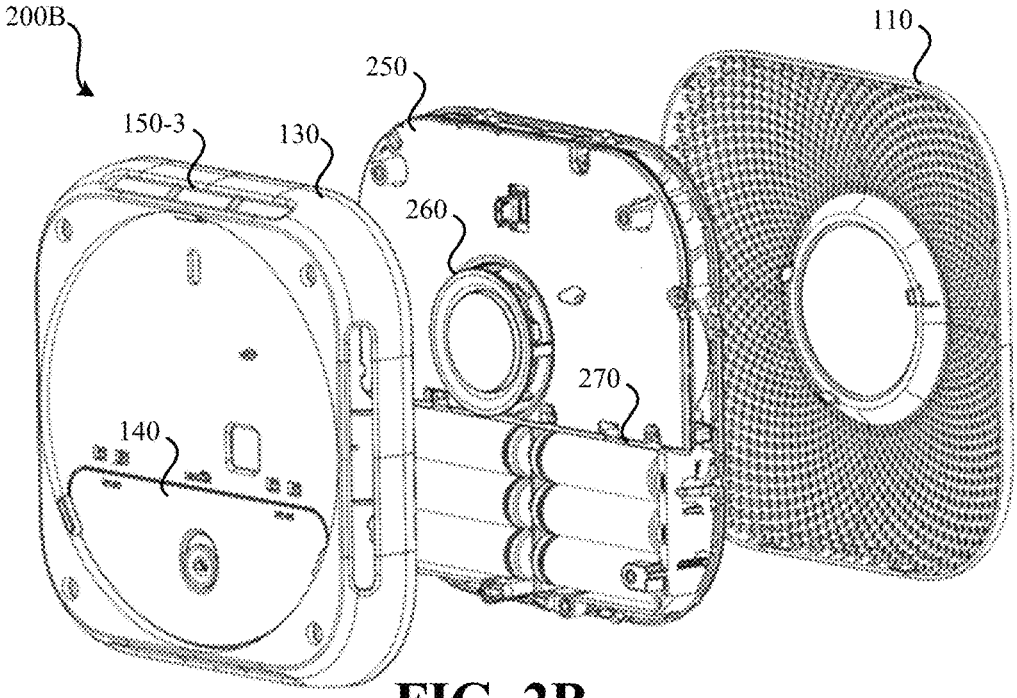

FIGS. 2A, 2B, 2C, and 2D illustrate an embodiment of an exploded smart combined smoke detector and carbon monoxide device. The devices of FIGS. 2A-2D can be understood as representing various views of devices 100A and 100B of FIGS. 1A and 1B, respectively. In FIG. 2A, device 200A is shown having cover grille 110 and enclosure 130, which together house main chassis 210. Main chassis 210 may house various components that can be present in various embodiments of device 200A, including speaker 220, light guide 230, and microphone 240. FIG. 2B of an embodiment of device 200B can be understood as illustrating the same device of FIG. 2A, from a different viewpoint. In FIG. 2B, cover grille 110, enclosure 130, airflow vent 150-3, and battery compartment door 140 are visible. Additionally visible is cover 250, which forms a shield between an underlying circuit board and enclosure 130. Protruding through cover 250 is smoke chamber 260. A gap may be present between enclosure 130 and main circuit board 288 to allow airflow through airflow vents 150 to have a relatively unobstructed path to enter and exit smoke chamber 260. Also present in FIG. 2B are multiple batteries, which are installed within battery compartment 270 of device 200B and which are accessible via battery compartment door 140. Some or all components on main circuit board 288 may be at least partially covered by one or more laminar flow covers (e.g., laminar flow cover 250). Such laminar flow covers can help laminar air flow within the device and prevent a user from inadvertently touching a component that could be sensitive to touch, such as via electro-static discharge.

Figure 2C:
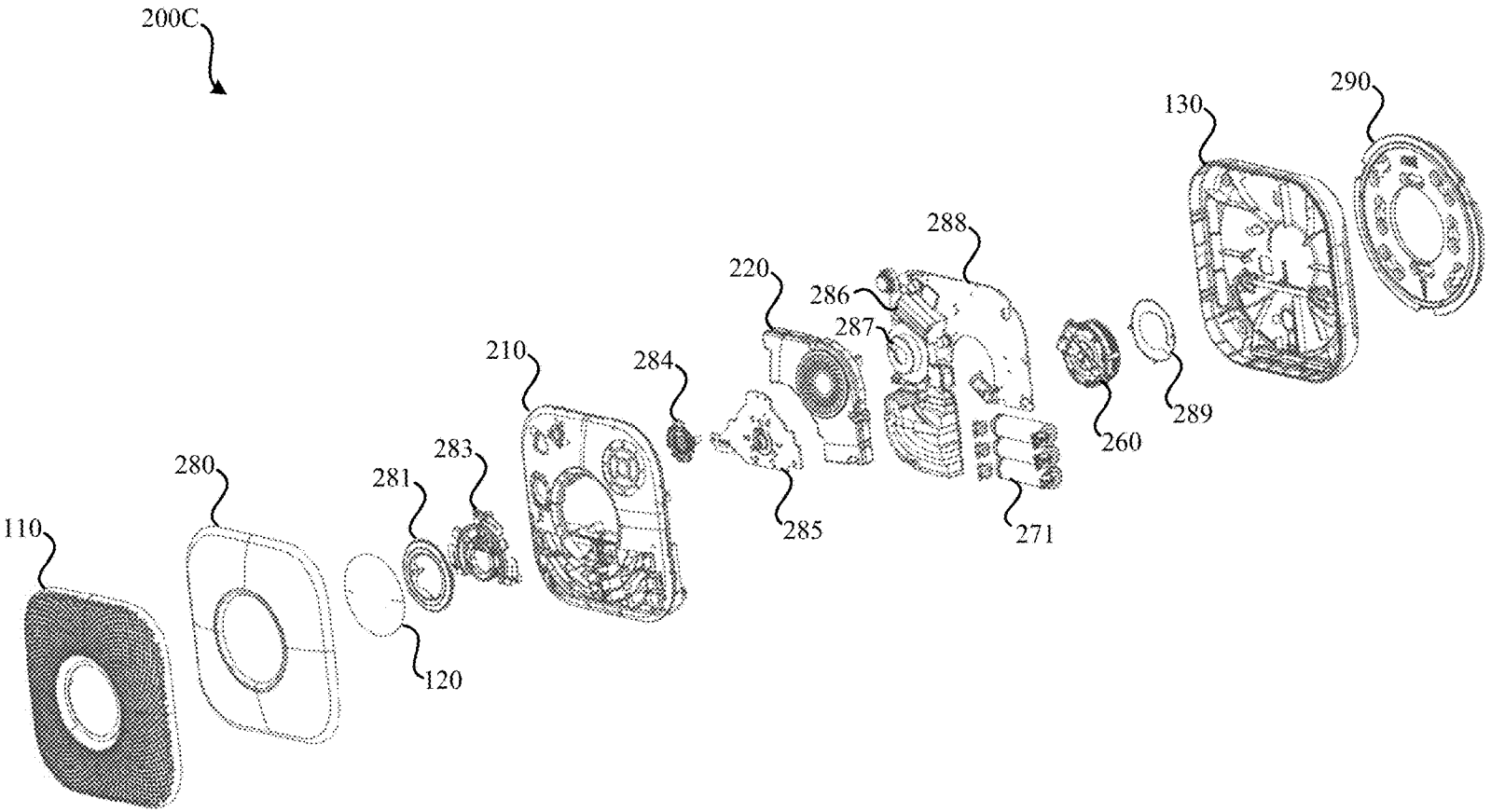

FIG. 2C represents a more comprehensive exploded view of a smart combined smoke detector and carbon monoxide detector device 200C. Device 200C may represent an alternate view of devices 100A, 100B, 200A, and 200B. Device 200C may include: cover grille 110, mesh 280, lens/button 120, light guide 281, button flexure 283, main chassis 210, diaphragm 284, passive infrared (PIR) and light emitting diode (LED) daughterboard 285, speaker 220, batteries 271, carbon monoxide (CO) sensor 286, buzzer 287, main circuit board 288, smoke chamber 260, chamber shield 289, enclosure 130, and surface mount plate 290. It should be understood that alternate embodiments of device 200C may include a greater number of components or fewer components than presented in FIG. 2C.

A brief description of the above-noted components that have yet to be described follows: Mesh 280 sits behind cover grille 110 to obscure external visibility of the underlying components of device 200C while allowing for airflow through mesh 280. Mesh 280 and cover grille 110 can help CO more readily enter the interior of the device, where CO sensor 286 is located. Light guide 281 serves to direct light generated by lights (e.g., LEDs such as the LEDs present on daughterboard 285) to the external environment of device 200C by reflecting off of a portion of cover grille 110. Button flexure 283 serves to allow a near-constant pressure to be placed by a user on various locations on lens/button 120 to cause actuation. Button flexure 283 may cause an actuation sensor located off-center from lens/button 120 to actuate in response to user-induced pressure on lens/button 120. Diaphragm 284 may help isolate the PIR sensor on daughterboard 285 from dust, bugs, and other matter that may affect performance. Daughterboard 285 may have multiple lights (e.g., LEDS) and a PIR (or other form of sensor). Daughterboard 285 may be in communication with components located on main circuit board 288. The PIR sensor or other form of sensor on daughterboard 285 may sense the external environment of device 200C through lens/button 120.

Buzzer 287, which may be activated to make noise in case of an emergency (and when testing emergency functionality), and carbon monoxide sensor 286 may be located on main circuit board 288. Main circuit board 288 may interface with one or more batteries 271, which serve as either the primary source of power for the device or as a backup source of power if another source, such as power received via a wire from the grid, is unavailable. Protruding through main circuit board may be smoke chamber 260, such that air (including smoke if present in the external environment) passing into enclosure 130 is likely to enter smoke chamber 260. Smoke chamber 260 may be capped by chamber shield 289, which may be conductive (e.g., metallic). Smoke chamber 260 may be encircled by a conductive (e.g., metallic) mesh (not pictured). Enclosure 130 may be attached and detached from surface mount plate 290. Surface mount plate 290 may be configured to be attached via one or more attachment mechanism (e.g., screws or nails) to a surface, such as a wall or ceiling, to remain in a fixed position. Enclosure 130 may be attached to surface mount plate 290 and rotated to a desired orientation (e.g., for aesthetic reasons). For instance, enclosure 130 may be rotated such that a side of enclosure 130 is parallel to an edge of where a wall meets the ceiling in the room in which device 200C is installed.

Figure 2D:
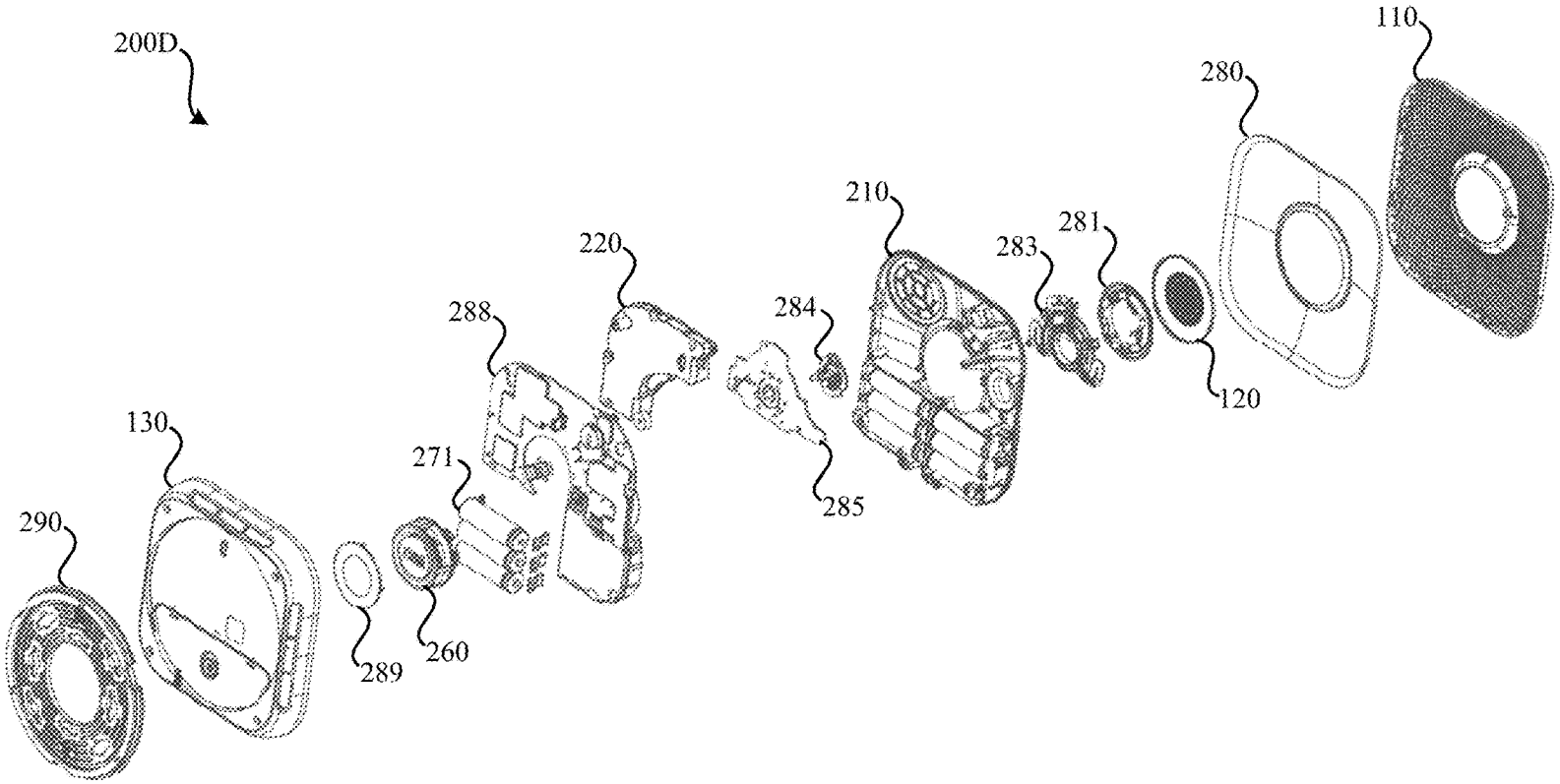

FIG. 2D represents the comprehensive exploded view of the smart combined smoke detector and carbon monoxide detector device of FIG. 2C viewed from a reverse angle as presented in FIG. 2C. Device 200D may represent an alternate view of devices 100A, 100B, 200A, 200B, and 200C. Device 200D may include: cover grille 110, mesh 280, lens/button 120, light guide 281, button flexure 283, main chassis 210, diaphragm 284, passive infrared (PIR) and light emitting diode (LED) daughterboard 285, batteries 271, speaker 220, carbon monoxide (CO) sensor 286, buzzer 287, main circuit board 288, smoke chamber 260, chamber shield 289, enclosure 130, and surface mount plate 290. It should be understood that alternate embodiments of device 200D may include a greater number of components or fewer components than presented in FIG. 2C.

Embodiments detailed herein may use at least some of the following components: a case (which may be in the form of a cover grille), a reflector, a light guide, and lighting elements. These components are detailed individually and in combination in the description that follows in combination with the associated figures.

Figure 3:
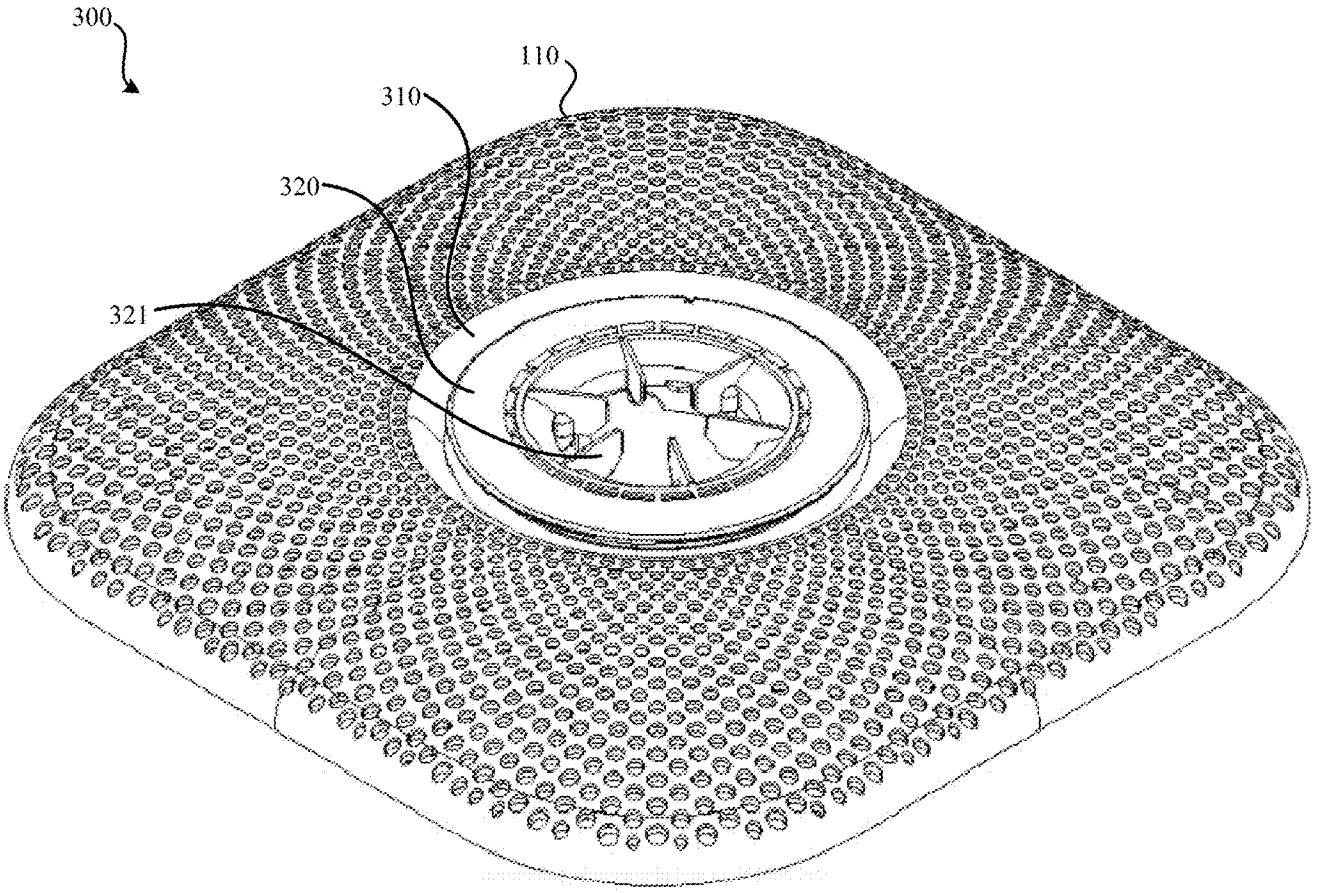
FIG. 3 illustrates an isometric top view of an embodiment of a cover grille with a conical reflector.

FIG. 3 illustrates an isometric top view of an embodiment 300 of a cover grille 110 with a reflector that may be part of a sensor device. Cover grille 110 may more generally be understood as part of a case of a sensor device. In some embodiments, cover grille 110 may have multiple apertures/holes (e.g., tens, hundreds, thousands) to facilitate airflow between an exterior environment of the sensor device and the interior of the sensor device. In the illustrated embodiment, hundreds of circular holes are arranged in an aesthetically-pleasing pattern. Cover grille 110 may include a depressed region 310. Depressed region 310 may not have airflow holes and may be depressed towards an interior of the sensor device. Depressed region 310 may have a circular, oval, or other rounded or curved shape. Depressed region 310 may be used to reflect and disperse light into the ambient environment of the sensor device.

Reflector 320 may be referred to as a conical reflector because at least one surface of the reflector 320 is conical. Reflector 320 may at least be partially set within depressed region 310 of cover grille 110. One purpose of reflector 320 can be to reflect light received from a light guide and reflect such light onto a depressed region 310 of cover grille 110. Reflector 320 may be incorporated as part of a multipurpose component. For instance, in some embodiments, reflector 320 is part of a button/lens assembly that can be actuated by a user. Further, additionally or alternatively, through the button/lens assembly, a sensor, such as a passive infrared sensor, may be used to detect occupancy and/or user-performed gestures in the vicinity of the sensor device. Reflector 320 may have multiple supports 321, such as support 321-1. Support 321-1 may be used for providing support for lens/button 120 (of FIG. 2C) that is coupled with a top portion of reflector 320.

Reflector 320 can be circular, oval, or some other rounded shape. As such, reflector 320 can reflect light in a 360° pattern. Therefore, light reflected by reflector 320 onto depressed region 310 may give an effect of a halo—that is, an illuminated perimeter of a circle or oval. Whether all or a portion of depressed region 310 is illuminated may be controlled by a number of lighting elements that are illuminated within the sensor device. In some embodiments, reflector 320 does not reflect light directly into an ambient environment of the sensor device. Rather, reflector 320 reflects light onto an exterior surface of cover grille 110. Cover grille 110 may reflect such light into the ambient environment of the sensor device.

Figure 4:
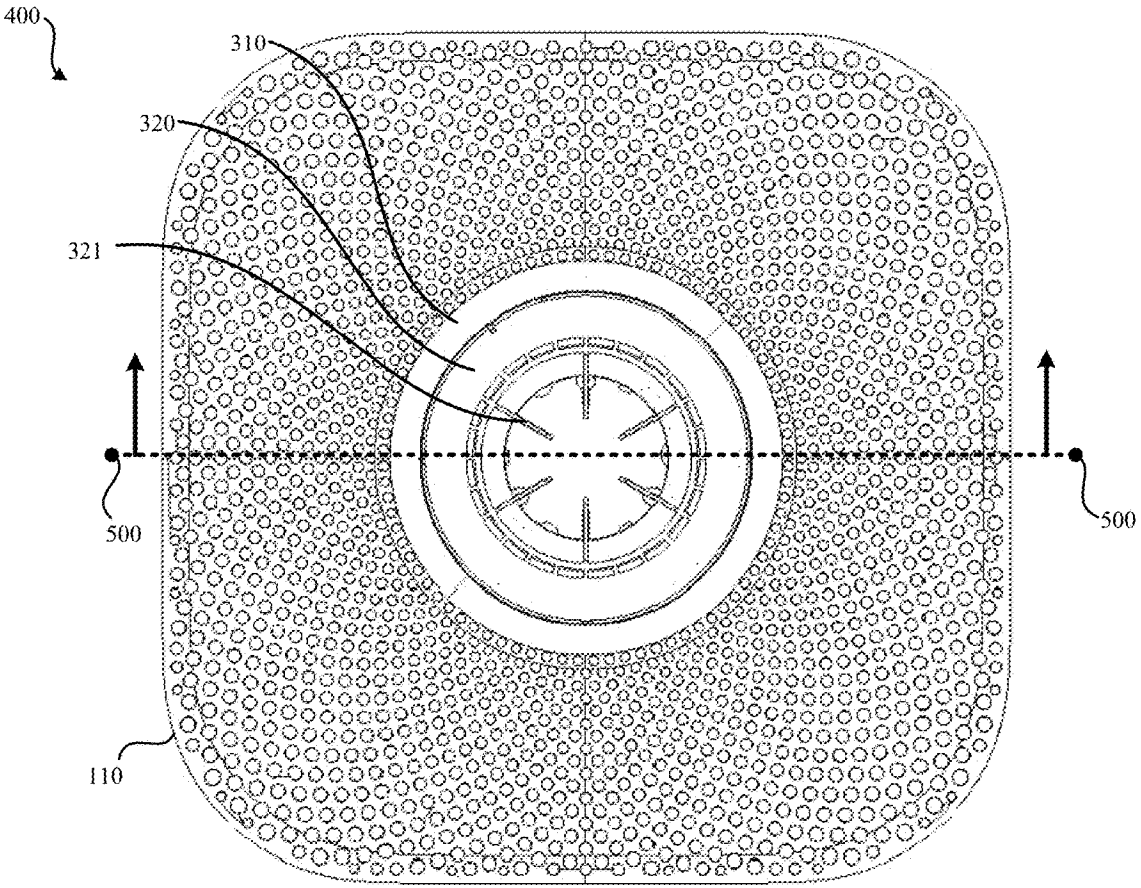
FIG. 4 illustrates a top view of an embodiment of a cover grille with a reflector.

FIG. 4 illustrates a top view of an embodiment 400 of cover grille 110 with reflector 320. When viewed from the top, in some embodiments it is not possible to see reflector 320 because it is fully obscured by lens/button 120 (which is not illustrated in FIG. 4). Similarly, a light guide located within the sensor device below reflector 320 may be fully obscured from view when the sensor device is viewed from the top as illustrated in FIG. 4. Embodiment 400 shows that reflector 320, when viewed from the top can be circular. Further, reflector 320 may be positioned in a center of cover grille 110. Similarly, depressed region 310 may encircle a center of cover grille 110. Depressed region 310 and reflector 320, when viewed from the top, may be concentric around a center point. An outer edge of cover grille 110 may generally be in the shape of the square or rectangle with rounded corners. The dotted line illustrates the location of cross-section 500 of FIG. 5A.

Figure 5A:
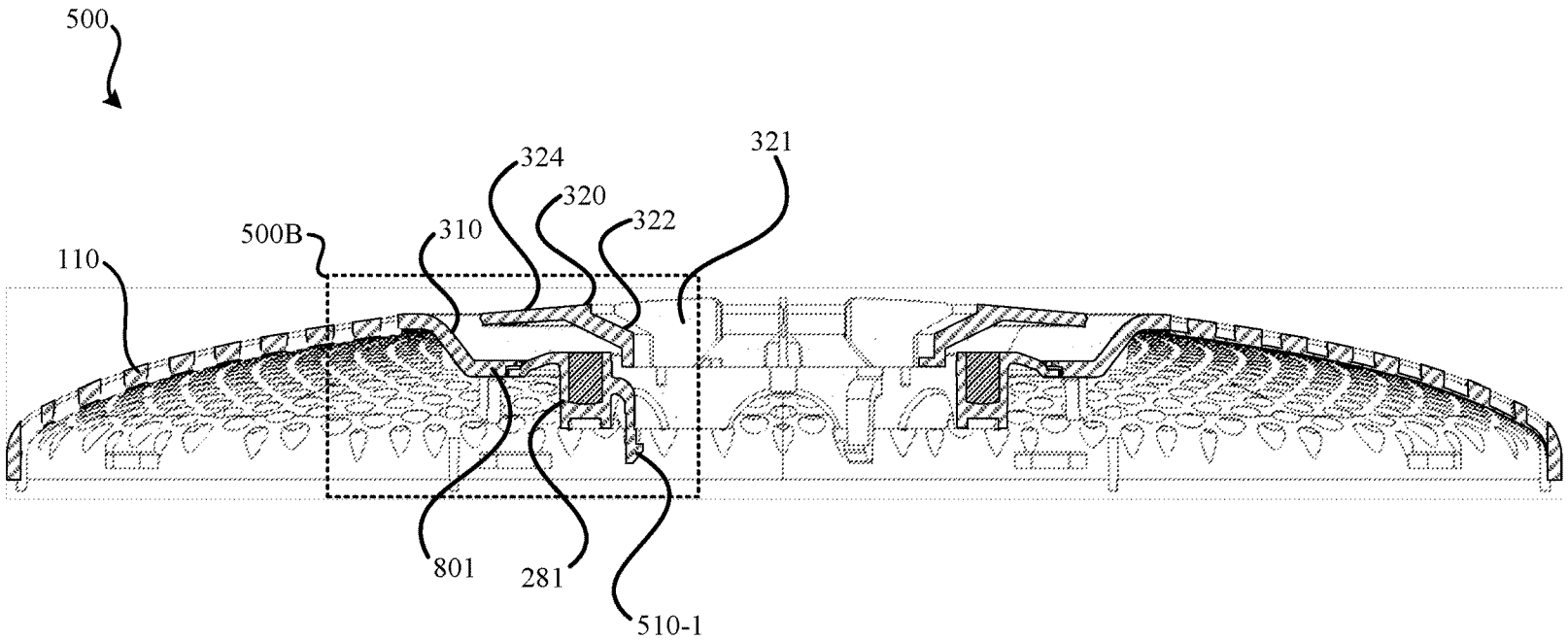
FIG. 5A illustrates an embodiment of a cross section of the cover grille with the reflector of FIG. 4.

FIG. 5A illustrates an embodiment of a cross-section 500 of the cover grille 110 with reflector 320 of FIG. 4. Cross-section 500 shows a cross-section of cover grille 110, depressed region 310, reflector 320, and light guide 281. When viewed as a cross-section, conical reflector 322 of reflector 320 can be seen. Conical reflector 322 may be geometrically shaped as a portion of a right circular cone. It should be understood that conical reflector 322 may be differently geometrically shaped, such as curved, part of a non-right cone, and/or part of a noncircular cone. Other shapes for conical reflector 322 may also be possible.

In cross-section 500, it can be seen that depressed region 310 can be circular, curved, and depressed. Generally, cover grille 110 increases in height towards a center of cover grille 110 until depressed region 310 is present. Therefore, where lens/button 120 is positioned atop reflector 320 may represent a furthest protruding location of the sensor device (e.g., a "crown" of the sensor device).

Light guide 281 is configured to receive light from multiple lighting elements, which may be LEDs and may include LEDs that emit light of different colors. Light guide 281 may route and disperse such admitted light onto conical reflector 322. Conical reflector 322 may reflect and disperse such light in a 360 degree pattern onto depressed region 310. Depressed region 310 may reflect and disperse such light into the ambient environment of the sensor device. Since a top surface of reflector 320 is not illuminated, the light emitted into the environment of the sensor device may be in the shape of a halo or another hollowed, curved shape. Extended portion 324, which may extend in a circular ring around conical reflector 322, may prevent light from being emitted from light guide 281 and directly entering the ambient environment of the sensor device. A gap may be present between depressed region 310 and extended portion 324 of reflector 320 in an uninterrupted circle around reflector 320. Extended portion 324 may also serve as a physical support for lens/button 120 (not pictured).

Figure 5B:
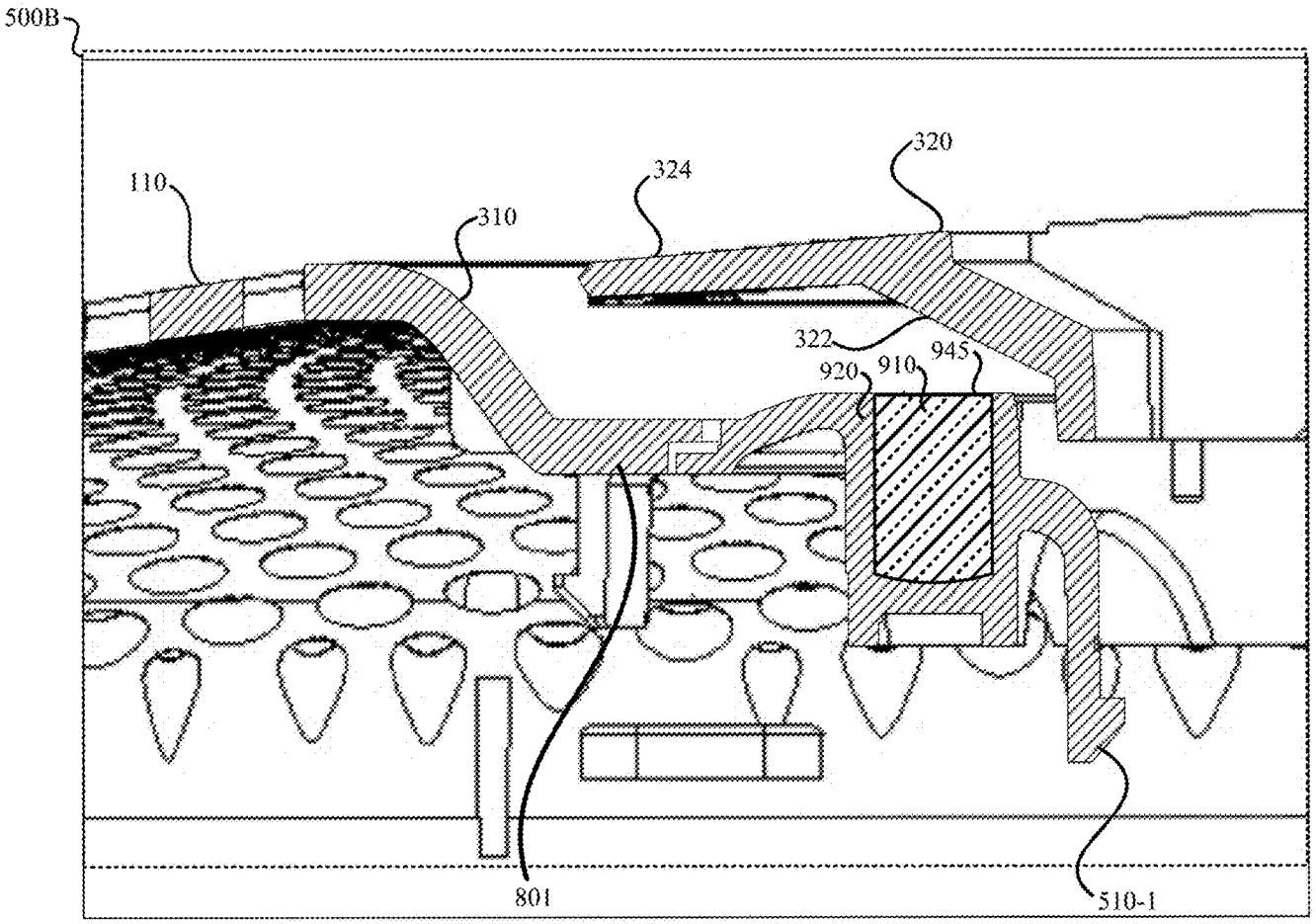
FIG. 5B illustrates an embodiment of a detailed portion of the cross section of the cover grille with the conical reflector of FIG. 5A.

FIG. 5B illustrates an embodiment of a detailed portion 500B of the cross section of the cover grille with the conical reflector and light guide of FIG. 5A. In detailed portion 500B of FIG. 5B, a cross-section of light guide is illustrated. A portion of light disperser 910 of the light guide can be seen. Light disperser 910 may be a transparent or semi-transparent plastic. Light disperser 910 may be surrounded on three sides by reflective cladding 920, which may be made from a plastic. Light disperser 910 may have a radially curved bottom within reflective cladding 920 to help disperse light within light disperser 910. Such plastic may be white in color and may include titanium dioxide as a pigment. Conical reflector 322 may also be plastic, white, and may use titanium dioxide as a pigment. Depressed region 310 and cover grille 110 may also be plastic, white, and may use titanium dioxide as a pigment. In some embodiments, other colors of depressed region 310 may be possible, such as black, which may match the color and material of cover grille 110.

Figure 6A:
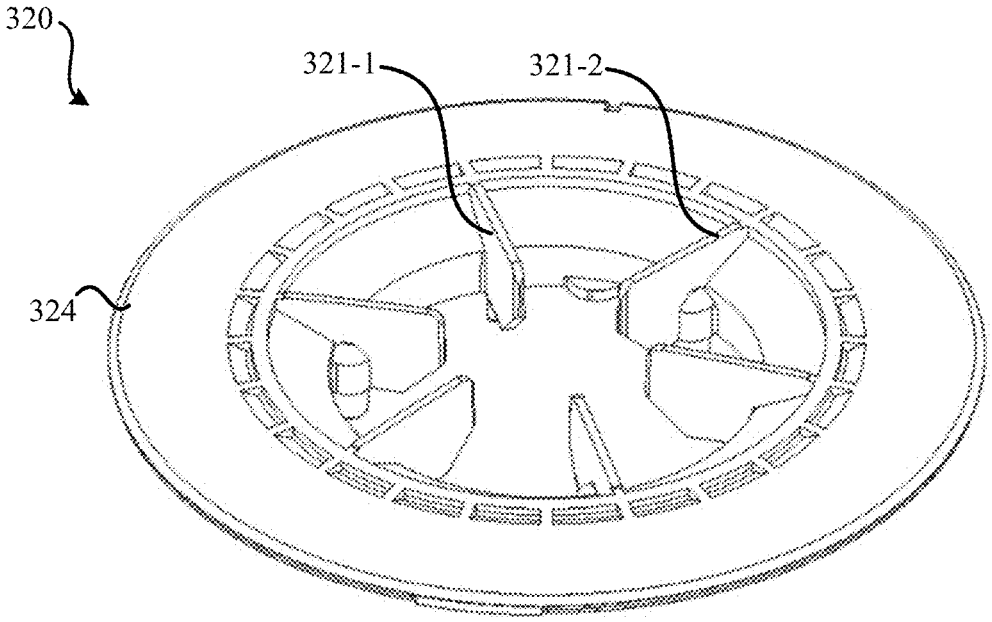
FIG. 6A illustrates an isometric top view of an embodiment of a conical reflector.
Figure 6B:
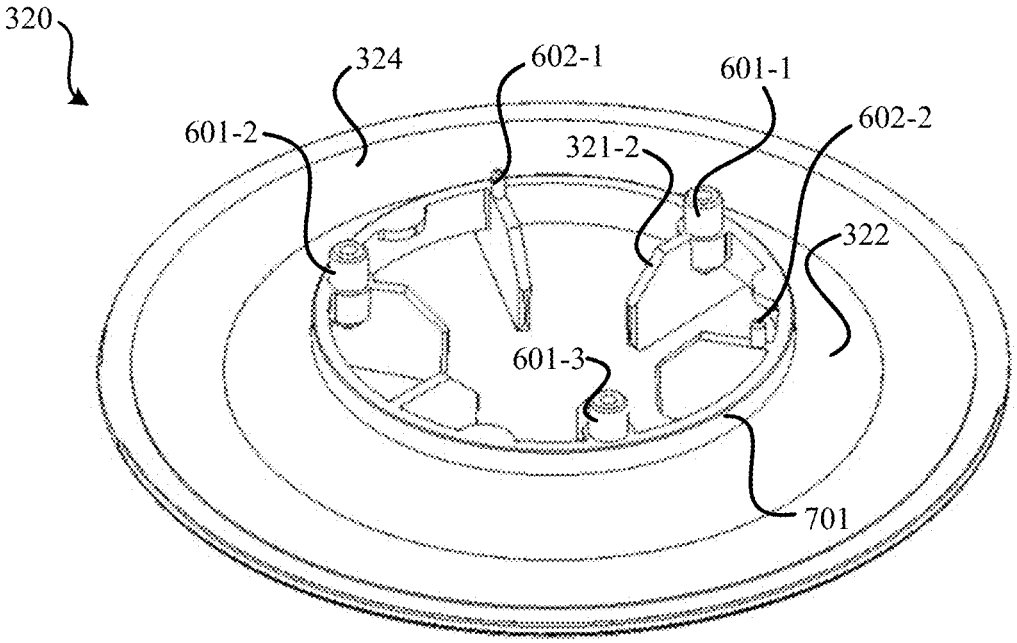
FIG. 6B illustrates an isometric bottom view of an embodiment of a conical reflector.

FIG. 6A illustrates an isometric top view of an embodiment of reflector 320. In FIG. 6A, the conical section of reflector 320 is hidden. Visible are supports, such as support 321-1 and support 321-2, and extended portion 324, which prevents light from escaping directly from the light guide into the ambient environment of the sensor device and serves to support lens/button 120. FIG. 6B illustrates an isometric bottom view of an embodiment of a reflector 320. Conical reflector 322 is visible and can be seen to form a right circular section of a cone. Other shapes for conical reflector 322 are also possible, such as another type of cone (e.g., non-right, non-circular) or some other form of curved or straight surface may be used. Conical reflector 322 may have a greater diameter toward the side of reflector 320 that is positioned closest to an exterior of the sensor device. That is, the diameter of conical reflector 322 may be smaller closer to the lighting elements than farther from the lighting elements which are positioned below light guide 281. Mounting supports 601 (601-1, 601-2, and 601-3) may be used to attach reflector 320 to button flexure 283 and maintain proper spacing from light guide 281. Conical reflector 322 (and, possibly, extended portion 324) may have a smooth reflective finish in order to reflect light (e.g., with minimal diffusion). In some embodiments, these surfaces may be textured to diffuse light. In some embodiments, reflector 320 or, more specifically, conical reflector 322 (and, possibly, extended portion 324) may be white or a light color such that all colors of light are primarily reflected rather than being absorbed. Rotational alignment pins 602 (e.g., 602-1, 602-2) may serve to ensure reflector 320 is rotationally aligned with button flexure 283. In some embodiments, only a single rotational alignment pin may be present; in other embodiments, more than two may be present. While reflector 320 may be symmetric, another component, such as lens/button 120, which can be mounted to reflector 320, may be asymmetric and require a particular rotational alignment with other components of the sensor device.

Figure 7A:
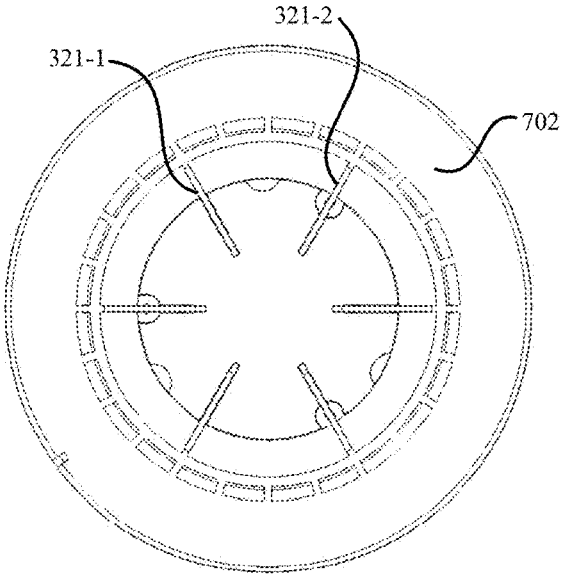
FIG. 7A illustrates a top view of an embodiment of a conical reflector.
Figure 7B:
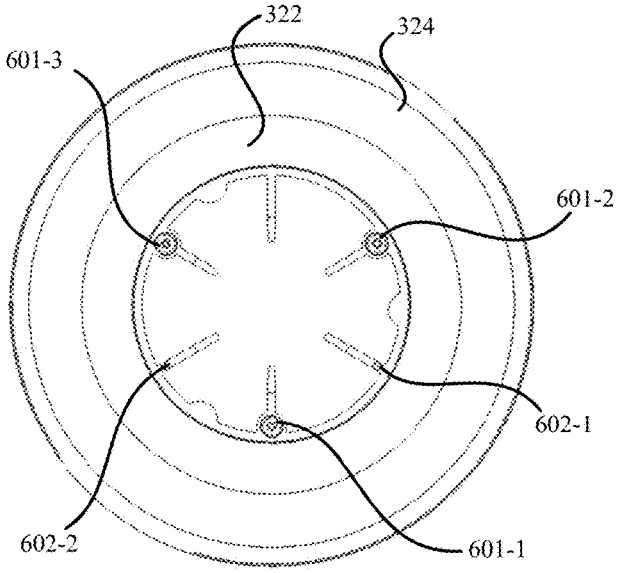
FIG. 7B illustrates a bottom view of an embodiment of a conical reflector.
Figure 7C:
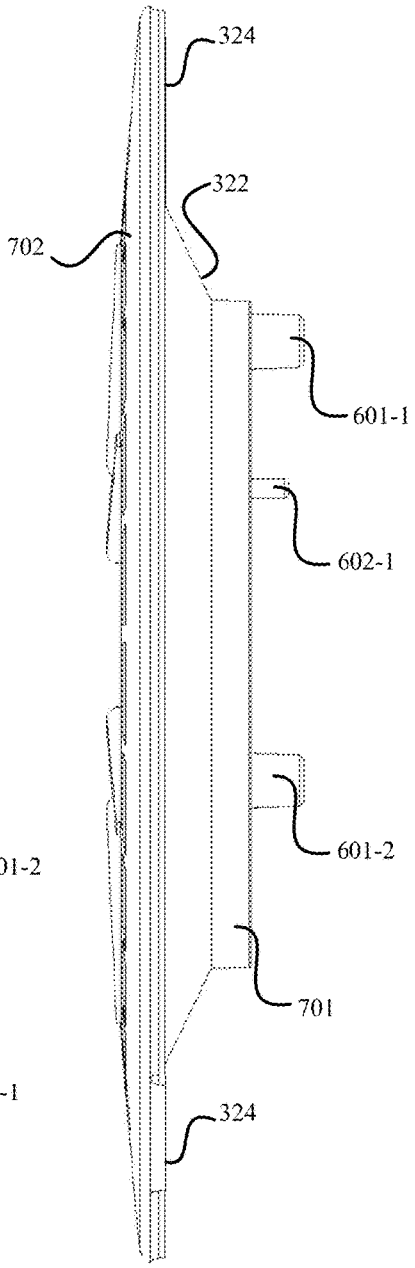
FIG. 7C illustrates a side view of an embodiment of a conical reflector.

FIG. 7A illustrates a top view of an embodiment of reflector 320. FIG. 7B illustrates a bottom view of an embodiment of reflector 320. FIG. 7C illustrates a side view of an embodiment of reflector 320. Reflector spacer 701 may serve to create a distance between conical reflector 322 and a light guide. Such space may permit ample space for light to diffuse when emitted by the light guide before being incident on conical reflector 322 and being reflected. Curved surface 702 may serve to prove support for a curved lens/button 120. Lens/button 120 may contact curved surface, including portions of supports 321 at multiple locations.

Figure 8B:
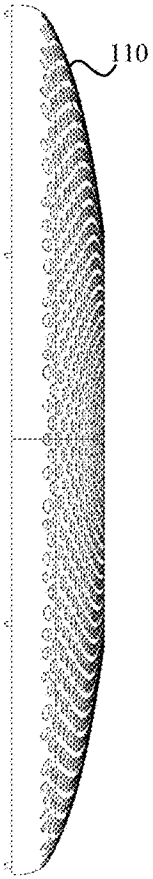
FIG. 8B illustrates a side view of an embodiment of a cover grille.
Figure 8A:
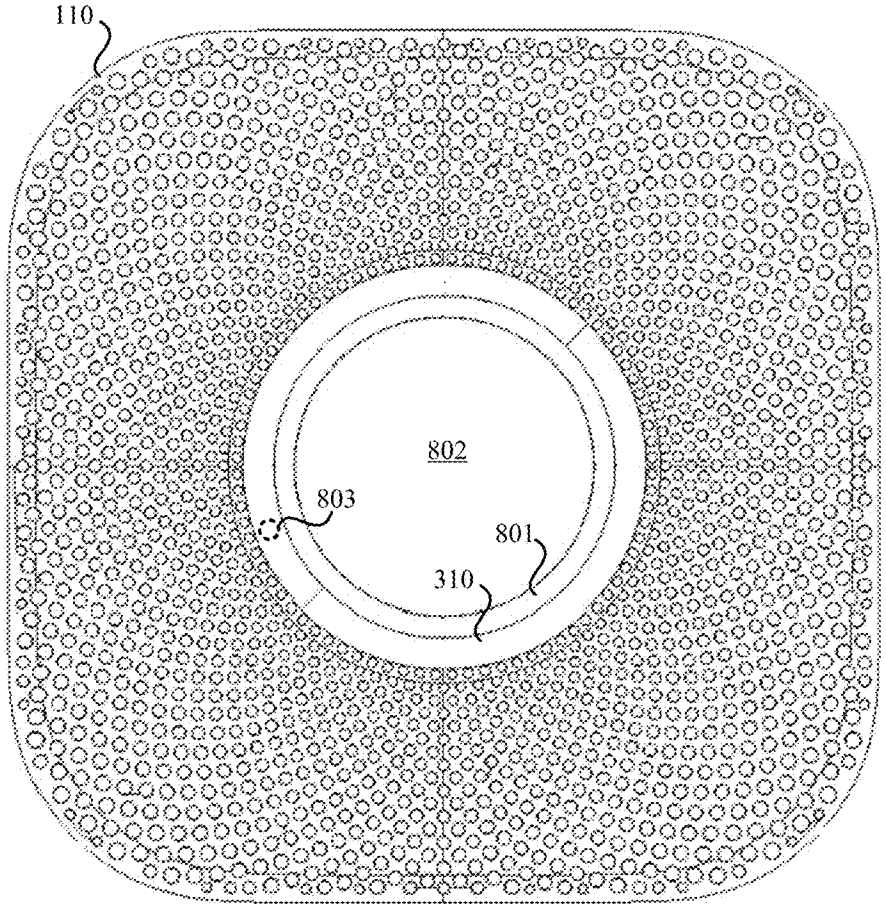
FIG. 8A illustrates a top view of a cover grille.

FIG. 8A illustrates a top view of cover grille 110. FIG. 8B illustrates a side view of an embodiment of cover grille 110. Cover grille 110 may have flat ring 801, which may serve to reflect incident light upwards. Flat ring 801, when the top of cover grille 110 is viewed from an angle, may help prevent a user from viewing internal components of the sensor device. Flat ring 801 may be white to reflect colored light incident upon it. Flat ring 801 may be smooth or textured. Region 802 may be empty to accommodate a reflector and light guide. Region 802 and flat ring 801 may be centered on cover grille 110. Cover grille 110 may be made from plastic or metal and may be white in color.

Present on depressed region 310 may be thinned material region 803. Thinned material region 803 may represent a region when the material of cover grille 110 is thinner than in other locations on depressed region 310. Thinned material region 803 may not be visible to a user unless a light is illuminated beneath thinned material region 803 (and thus shines through thinned material region 803). When such a light is not illuminated, thinned material region 803 may appear similar to other parts of depressed region 301. The thickness of thinned material region 803 may be determined based on the type of material and color of depressed region 310. That is, in order for the illuminated light to be visible through thinned material region 803, the thickness of the material is determined to compensate for the opacity of the material, including the color of depressed region 310 (e.g., if depressed region 310 is black, it may need to be thinner than if white to permit sufficient light to pass through thinned material region 803).

Figure 9:
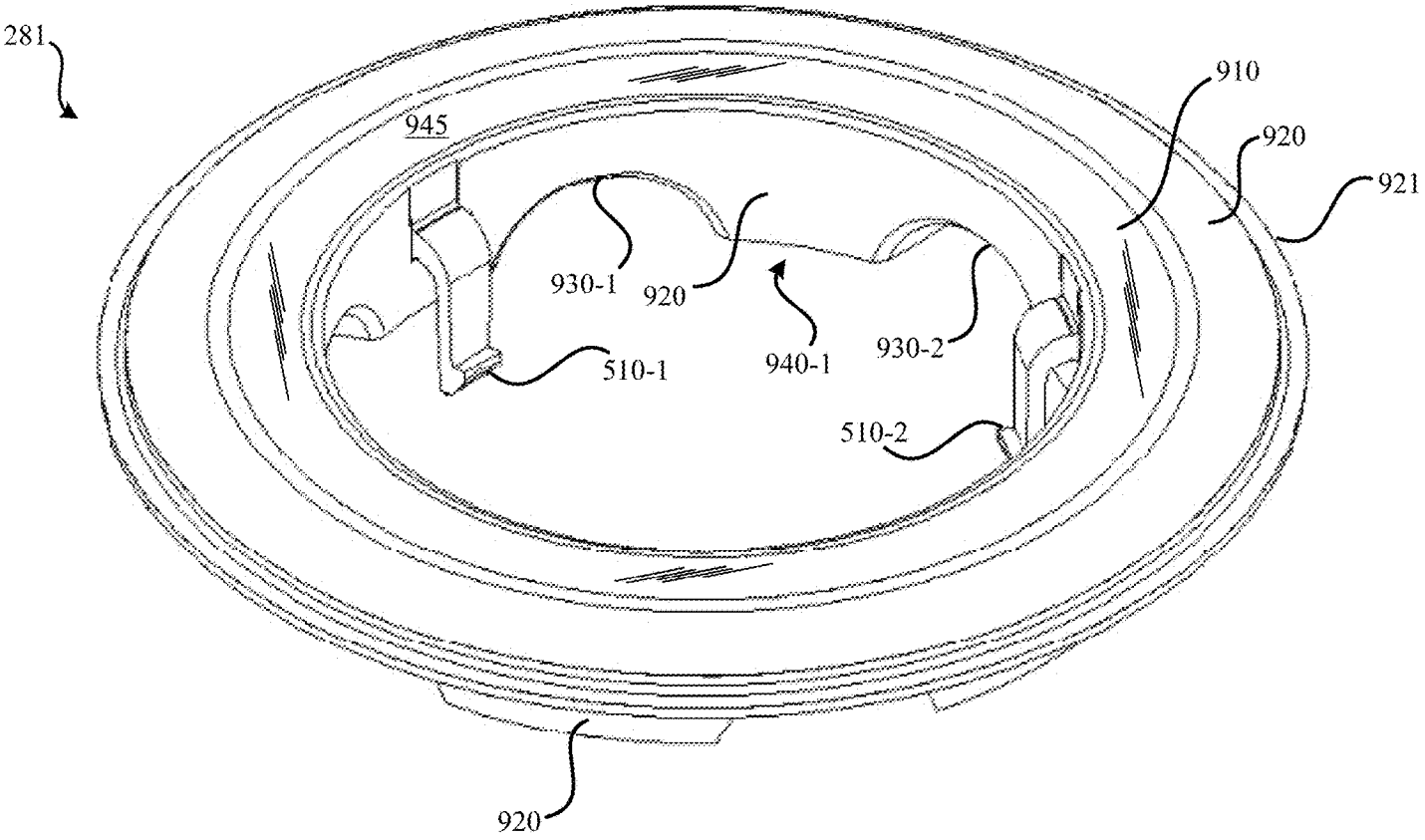
FIG. 9 illustrates an isometric top view of an embodiment of a circular light guide.

FIG. 9 illustrates an isometric top view of an embodiment of circular light guide 281. Circular light guide 281 may include: light disperser 910, reflective cladding 920, clips 510, and diffuser arcs 930. Light disperser 910 may be a transparent or at least translucent material that allows light to pass through. For instance, light disperser 910 may be made from some form of transparent or translucent plastic. Light disperser 910 may receive light through light receptacles 940 and may primarily admit light through halo surface 945. Light receptacles 940, which are not visible in the presented view of FIG. 9, may receive light from one or more lighting elements. Once light has entered light disperser 910, light disperser 910, in combination with reflective cladding 920, may serve to distribute and diffuse light such that such light is primarily emitted from halo surface 945. Halo surface 945 may be textured to help diffuse emitted light. Light emitted from halo surface 945 may primarily pass through air and then be incident on conical reflector 322.

Reflective cladding 920 may at least partially encircle light disperser 910. Reflective cladding may be present on the outside and inside of light disperser 910 such as to prevent light from exiting sides of light disperser 910. Reflective cladding 920 may coat the entirety of light disperser 910 except for halo surface 945 and light receptacles 940. In some embodiments, reflective cladding 920 is a combination of plastic and titanium dioxide and may have a white color. In some embodiments, reflective cladding 920 and light disperser 910 are formed during manufacturing as a single, solid object.

Light receptacles 940, of which there may be six, may be arranged in a circular pattern such that a light receptacle pairs with a LED or group of LEDs (e.g., 6 groups of LEDs) present on a circuit board located beneath light guide 281. Interspersed with light receptacles 940 may be diffuser arcs 930 (e.g., six diffuser arcs), such as diffuser arc 930-1. While the illustrated embodiments are configured to accommodate six LEDs, or six groups of LEDs, arranged in a circular pattern, it should be understood that embodiments may be adapted for fewer or greater numbers of LED groups or LEDs and/or for different shapes. Diffuser arcs 930 may be covered with reflective cladding 920. Light that enters a light receptacle, such as light receptacle 940-1 and is being transmitted by light disperser 910, may be incident upon an interior surface of diffuser arc 930-1. Such a diffuser arc may serve to further disperse such light within light disperser 910. Also present on light guide 281, may be one or more clips 510. Clips 510 may serve to (removably) couple light guide 281 to button flexure 283.

Figure 10B:
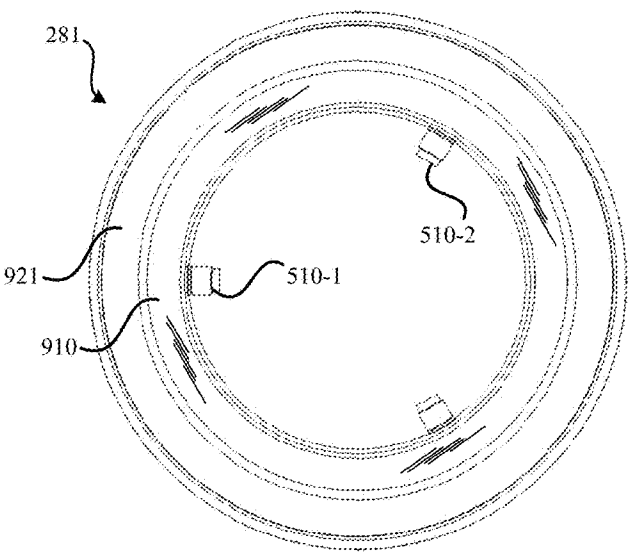
FIG. 10B illustrates a top view of an embodiment of a circular light guide.
Figure 10A:
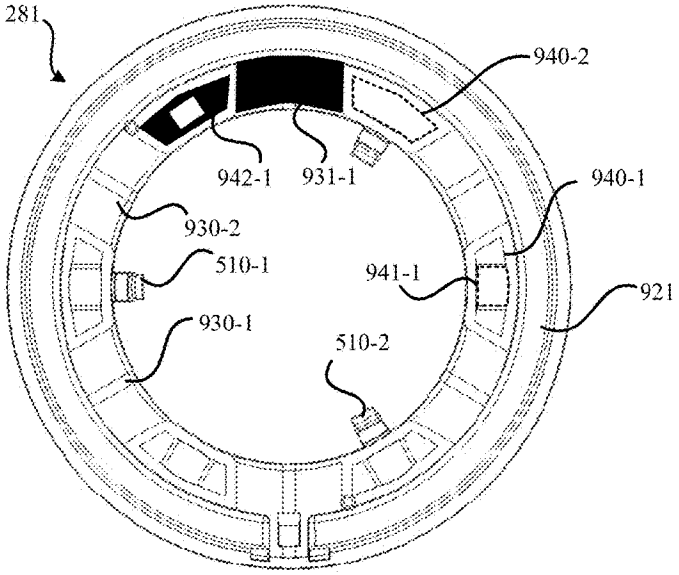
FIG. 10A illustrates a bottom view of an embodiment of a circular light guide.
Figure 10C:
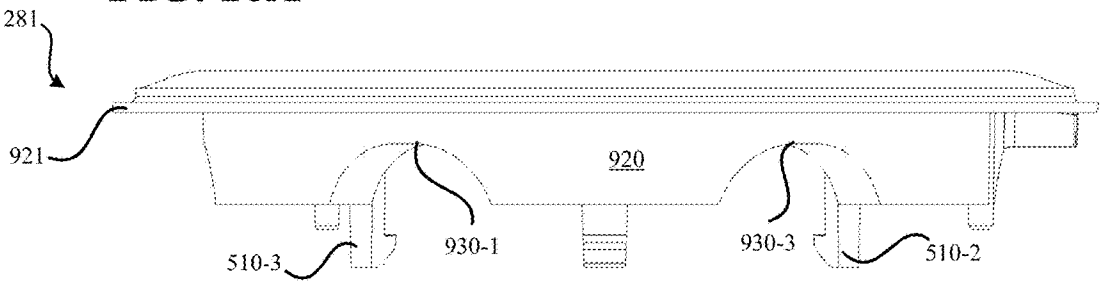
FIG. 10C illustrates a side view of an embodiment of a circular light guide.

FIG. 10A illustrates a bottom view of an embodiment of a circular light guide. FIG. 10B illustrates a top view of the embodiment of a circular light guide. FIG. 10C illustrates a side view of the embodiment of a circular light guide. In FIG. 10A, light receptacles 940, such as light receptacle 940-2, can be seen. Light receptacles 940 which can be arranged in a circular pattern on the bottom of the light guide may include an exposed portion of light disperser 910, such that light emitted by a light source into light receptacles 940 enters light disperser 910. Within each light receptacle may be a parabolic collector, such as parabolic collector 941-1. A surface of parabolic collectors 941 may be in the shape of a parabola and may serve to collect and disperse light received from a lighting source into light disperser 910. Between each light receptacle of light receptacles 940, a diffuser arc of diffuser arcs 930 may be present. The exterior of each diffuser arc of diffuser arcs 930 may be covered with reflective cladding 920. Additionally, the outer surface of diffuser arcs 930 may be coated with a blackout or insulator material to form arc insulators 931. For instance, arc insulator 931-1 covers an exterior surface of a diffuser arc. Such a blackout material may help prevent any light escaping through the diffuser arc from illuminating any internal components of the sensor device. Similarly, light receptacle insulator windows 942 may represent blackout material placed over a portion of light receptacles 940. Light receptacle insulator windows 942 may have an aperture that permits light emitted from a light emitter or group of light emitters to enter light disperser 910 via parabolic collectors 941. Light receptacle insulator windows 942 may help prevent reflected or otherwise diffuse light from exiting light disperser 910 via light receptacles 940 and illuminating any internal components of the sensor device. While only a single light receptacle insulator window 942-1 and a single arc insulator 931 are illustrated, it should be understood that such components may be present on light guide 281 for each diffuser arc of diffuser arcs 930 and each light receptacle of light receptacles 940. Ideally, all light emitted into light receptacles 940 is diffused by light disperser 910 and emitted through halo surface 945. Diffuser arcs 930, which are covered with reflective cladding, help to internally disperse light within light disperser 910. Reflective cladding lip 921 may help reflect the light that has been reflected by conical reflector 322 and/or extended portion 324 towards an exterior surface of the cover grille. The insulator material used may be glued or taped to the exterior of the light guide.

Each light receptacle of light receptacles 940 may be configured to receive light from multiple light emitters, such as a group of LEDs. For each light receptacle of light receptacles 940, a red, green, and a blue LED may be present. Light disperser 910 may effectively cause light from each different colored LED to effectively be admitted by halo surface 945 in a similar illumination pattern. Thus, as reflected by the exterior of the cover grille, a substantially even glow is emitted into the ambient environment regardless of the one or more colored LEDs (or other type of lighting elements) illuminated.

Figure 11:
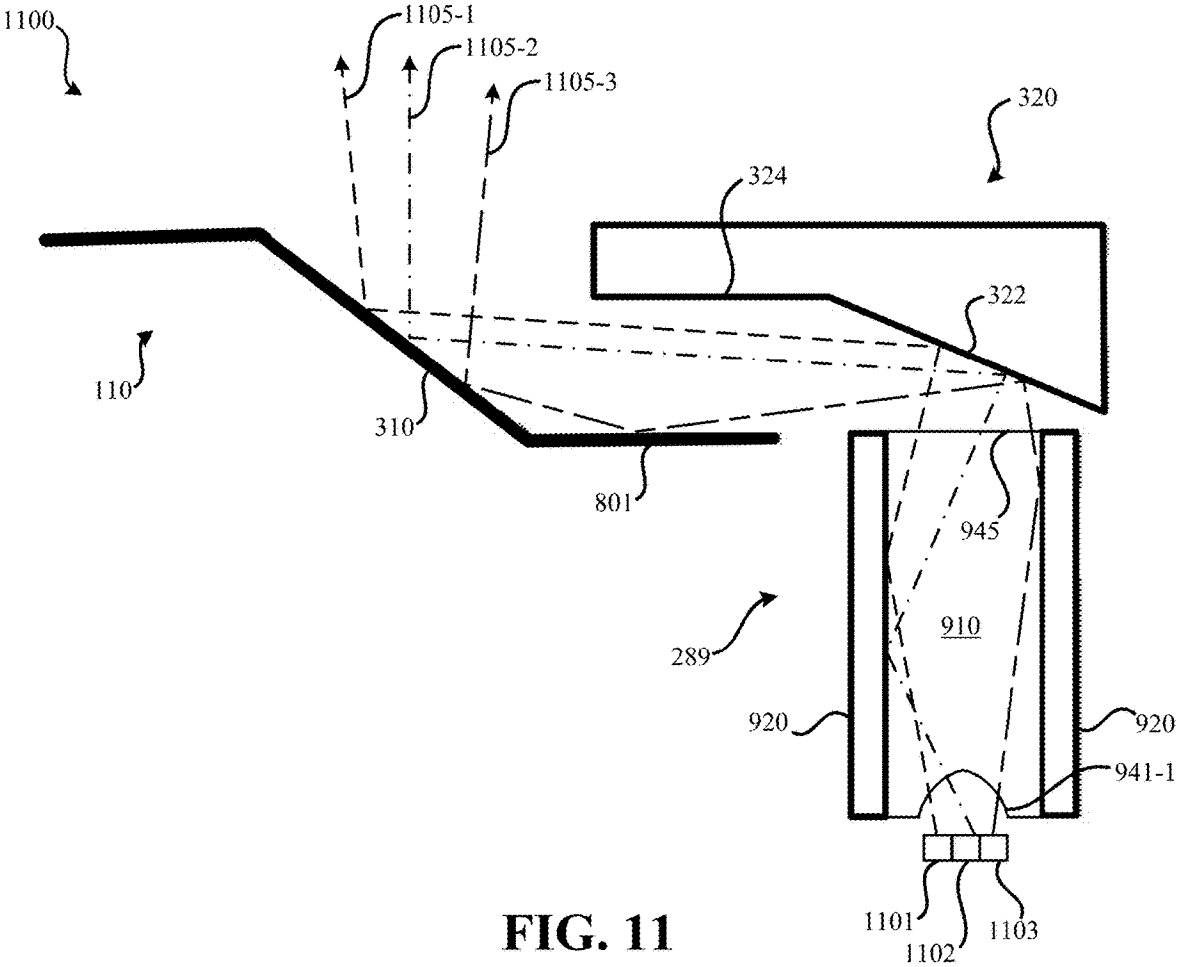
FIG. 11 illustrates light paths from an emitter to an external environment.

FIG. 11 illustrates light rays 1105 from light emitters 1101, 1102, and 1103 to an external (ambient) environment of a sensor device. For the purposes of FIG. 11, the illustrated components have been simplified. In FIG. 11, exemplary light paths from light emitters 1101, 1102, 1103 through light guide 281, reflected off conical reflector 322, to depressed region 310 are illustrated. In illustrated embodiment 1100, three emitters, which may be LEDs that produce different colors of light, may commit light into a single light receptacle having parabolic collector 941-1. For instance, light emitter 1101 may be a red LED, light emitter 1102 may be a green LED, and light emitter 1103 may be a blue LED. It should be noted that light rays 1105 are mere approximations intended to generally show a light may pass through light guide 281, reflect off conical reflector 322, and reflect off a depressed region of cover grille 110 into the ambient environment.

First, light emitted from any of light emitters 1101, 1102, and 1103 may enter parabolic collector 941-1. Parabolic collector 941-1 may serve to disperse light into light guide 281. In the cross-section of light guide 281 illustrated, reflective cladding 920 is present on either side of light disperser 910. As such, light that is incident upon a side of light disperser 910 may be reflected by reflective cladding 920. A significant portion of the light emitted into light disperser 910 may emanate from halo surface 945, which may be textured to help diffuse the light. A portion of the light emitted from halo surface 945 may be incident upon conical reflector 322. Conical reflector 322 of reflector 320, possibly in combination with extended portion 324, may reflect light away from reflector 320 towards cover grille 110. Such light may be incident upon depressed region 310 and/or flat ring 801. At least a portion of such light may then be reflected out into an ambient environment of the sensor device. The surface of depressed region 310 may be textured in order to further cause diffusion of light incident upon such surface.

Figure 12A:
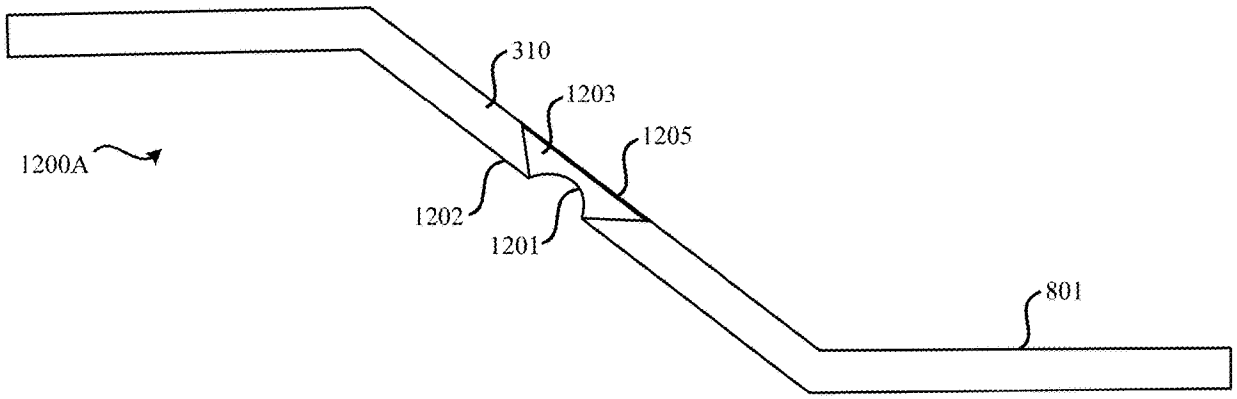
FIGS. 12A and 12B illustrate embodiments of a cover grille that permits through-grille illumination.
Figure 12B:
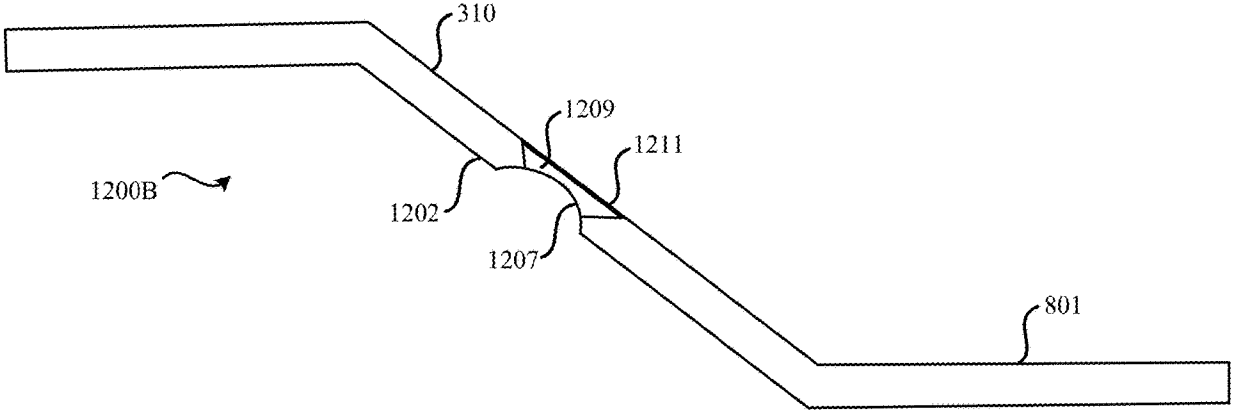

FIGS. 12A and 12B illustrates a cross section of a cover grille that permits through-grille illumination. When such through-grille illumination is not active, the exterior surface of the cover grille appears as a uniform surface as detailed below. In embodiment 1200A, a first cross-section of a cover grille is presented. In this cross-section, a cross-section of depressed region 310 and flat ring 801 are presented. At least partially based on the opacity of the material, a portion of depressed region 310 is thinned during manufacturing to create thinned region 1201. Thinned region 1201 is thinner than other parts of the cover grille, such as other portions of depressed region 310 and/or flat ring 801, and therefore more readily transmits light. Thinned region 1201 may represent a curved region in which less material is present than in other regions of the cover grille. Thinned region 1201 can be thin enough to permit transmission of light through light transmission region 1203 such that the light exits top surface 1205. Once a light is illuminated below thinned region 1201, light transmission region 1203 may appear illuminated to a user viewing top surface 1205. When a light is not illuminated within the sensor device below thinned region 1201, top surface 1205 may be indistinguishable from a remainder of depressed region 310, effectively rendering the location of any underlying unilluminated light invisible to a user.

In embodiment 1200B of FIG. 12B, a cross-section of a cover grille made of a material that has a higher opacity than the material of embodiment 1200A is presented. For instance, embodiment 1200A may represent a form of white plastic while embodiment 1200B may represent the same type of plastic, but with black coloring. In this cross-section, a cross-section of depressed region 310 and flat ring 801 are presented. Depending on the opacity of the material, a portion of depressed region 310 may be thinned to create thinned region 1207. Thinned region 1207 is thinner than other parts of the cover grille, such as other portions of depressed region 310 and/or flat ring 801. Thinned region 1207 may represent a curved region in which less material is present than in other regions of the cover grille. Thinned region 1207 may be thin enough to permit transmission of light through light transmission region 1209 such that the light exits top surface 1211 into the ambient environment of the sensor device. Thinned region 1207 may represent a larger thinned region than thinned region 1201, resulting in thinned region 1207 having a minimum thickness that is less than the minimum thickness of thinned region 1201. The thinness compensates for the greater material opacity such that light can be transmitted into the ambient environment. To achieve the smaller minimum thickness of thinned region 1207, a larger thinned region (which occupies a greater area on depressed region underside 1202) may be manufactured on depressed region underside 1202 of embodiment 1200B as compared with thinned region 1201 on depressed region underside 1202 of embodiment 1200A.

Figure 13:
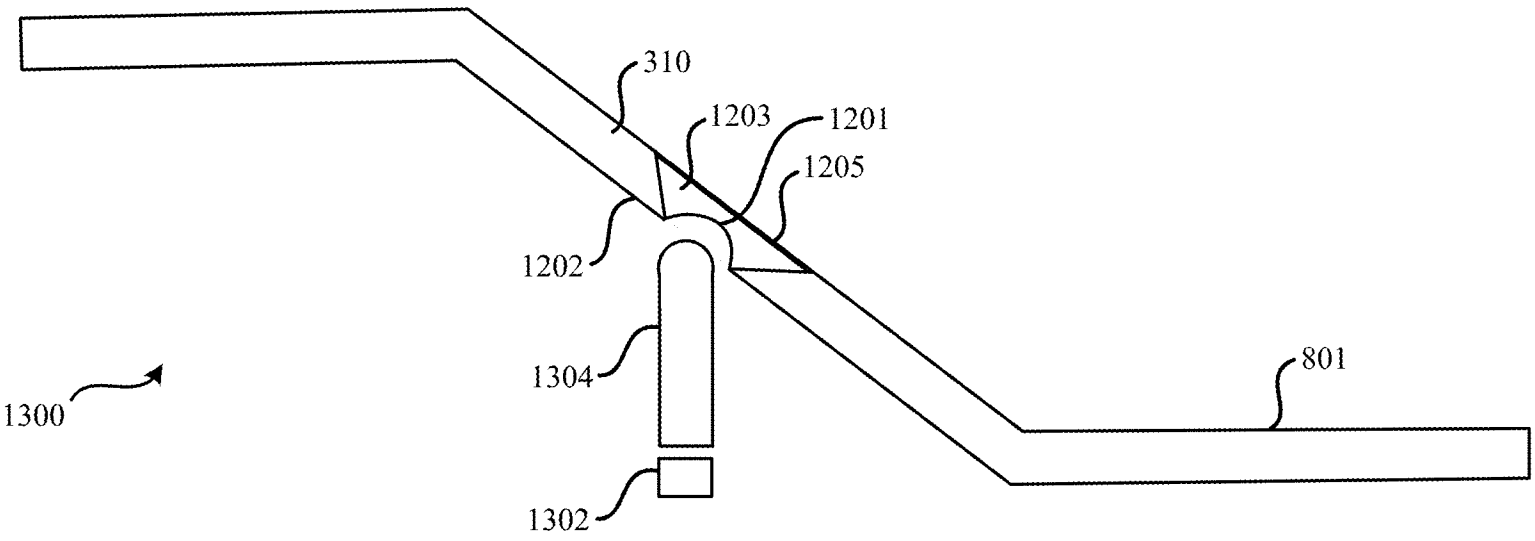
FIG. 13 illustrates an embodiment of a through-grille illumination system.

FIG. 13 illustrates an embodiment of a through-grille illumination system 1300. Through-grille illumination system 1300 may represent embodiment 1200A, with the addition of a lighting element 1302 and a light guide 1304. As an example, through-grille illumination system 1300 may be used to identify a status of whether a sensor device is receiving power from an external source, such as a wired electrical system of a structure (e.g., house). If the light is illuminated, power may be being received; if the light is not illuminated, power is not being received and, possibly, the sensor device may be operating from a backup, on-board battery power source. Lighting element 1302 may be a light, such as an LED, which may be surface mounted on a printed circuit board (PCB). Light guide 1304 may direct light from lighting element 1302 to thinned region 1201. Light guide 1304 may be rectangular or cylindrical and may have a top section, nearest to depressed region 310, that is spherical or, more generally, curved, to distribute light into light transmission region 1203. When lighting element 1302 is illuminated, light transmission region 1203 may appear to glow to a user viewing the sensor device from an exterior position; when lighting element 1302 is not illuminated, light transmission region 1203 may be indistinguishable from a remainder of depressed region 310.

Figure 14:
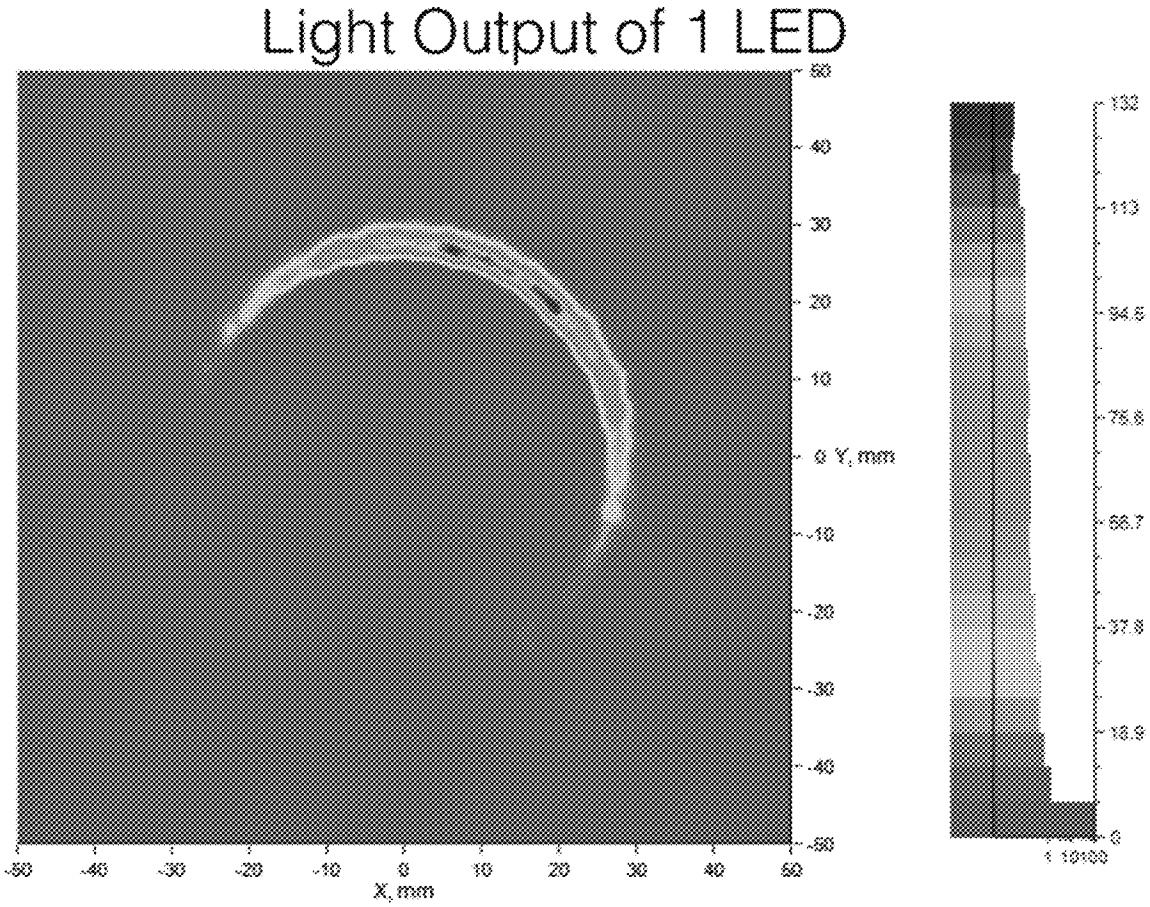
FIG. 14 is a graph of a simulation of the light output by an even-glow illumination system when a single emitter is active.

FIG. 14 is a graph of a simulation of the light output by an even-glow illumination system when a single emitter is active. In this simulation, the relative amount of light reflected off of an exterior, depressed region of a cover grille is simulated. (As such, the absolute measurement of light output by each LED is essentially inconsequential. Increasing the simulation brightness of the LED's would create a wider distribution between non-interacting surfaces and the light ring but within the lighted area, the relative intensities would remain essentially the same.) The simulation indicates the amount of light output by an even-glow illumination system having six LEDs (or six groups of LEDs) arranged in a circular pattern, of which only a single LED is illuminated, shining light into a single light receptacle of a light guide. The LED outputs light into a light guide, which emits the light to a conical reflector, which, in turn, reflects the light to a depressed region of a cover grille, as detailed in relation to FIGS. 3-11.

Figure 15:
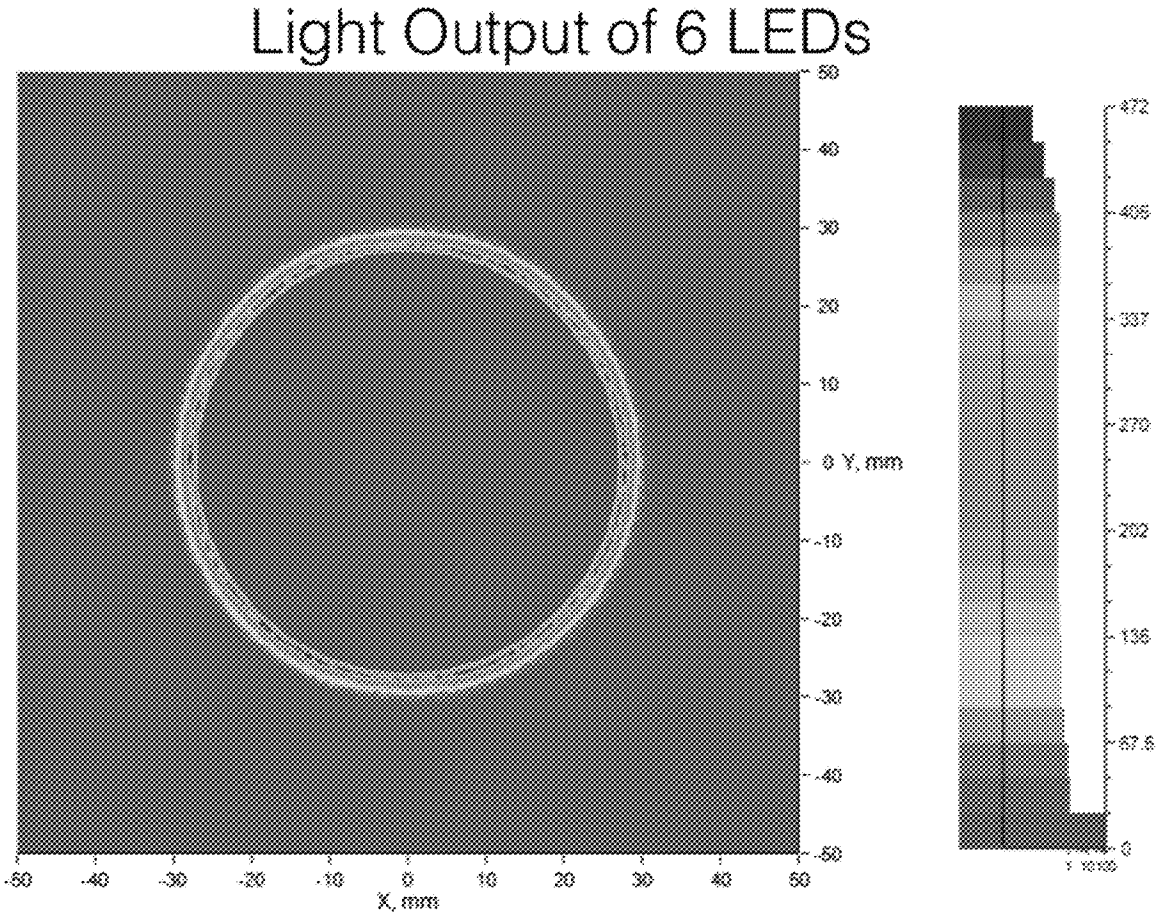
FIG. 15 is a graph of a simulation of the light output by an even-glow illumination system when all six emitters are active.

FIG. 15 is a graph of a simulation of the light output by an even-glow illumination system when light is emitted into each light receptacle of a light guide. In this simulation, the amount of light reflected off of an exterior, depressed region of a cover grille is simulated. As in FIG. 14, the relative amount of light reflected off of an exterior, depressed region of a cover grille is simulated. The simulation indicates the amount of light output by an even-glow illumination system having six LEDs (or six groups of LEDs) arranged in a circular pattern, of which each LED (or an LED in each group of LEDs) is illuminated into each light receptacle of a light guide. The LED outputs light into the light guide, which emits the light to a conical reflector, which, in turn, reflects the light to a depressed region of a cover grille, as detailed in relation to FIGS. 3-11. As can be seen, in the halo light pattern, a minimum brightness of 337 Nits (1 candela/$m^2$) is continuously present around the halo. In other embodiments, a minimum brightness of 3330 Nits, 300 Nits, 280 Nits, 200 Nits, or any value in-between may be realized as continuously present around the halo as generated by a number of LEDs, such as six, the halo having a radius of about 56 mm. It should be understood that other embodiments may have the radius of the halo adjusted to be greater or smaller depending on the sizing of the various components of the system.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. A combination carbon monoxide and smoke detector, comprising:

a case;

a carbon monoxide sensor housed within the case;

a smoke sensor housed within the case;

a plurality of light emitters arranged in a circular pattern and mounted within the case;

a light guide comprising a light disperser that: is formed from a translucent or transparent material, is partially surrounded in reflective cladding, and that receives light from the plurality of light emitters and emits the light through a halo-shaped surface of the light disperser;

a reflector that reflects light emitted by the plurality of light emitters arranged in the circular pattern through the halo-shaped surface of the light guide into an ambient environment of the combination carbon monoxide and smoke detector; and one or more processors housed within the case, wherein:

the one or more processors are in communication with the carbon monoxide sensor, the smoke sensor, and the plurality of light emitters; and the one or more processors are configured to activate the plurality of light emitters such that light is emitted into the ambient environment in a halo shaped pattern having an even glow.

2. The combination carbon monoxide and smoke detector of claim 1, wherein the plurality of light emitters comprises at least six light emitters arranged in the circular pattern.

3. The combination carbon monoxide and smoke detector of claim 1, wherein the plurality of light emitters emit light in a plurality of colors.

4. The combination carbon monoxide and smoke detector of claim 3, wherein the plurality of light emitters emit light in the halo shaped pattern in the colors of red, green, and blue.

5. The combination carbon monoxide and smoke detector of claim 1, further comprising a button, wherein the light emitted by the plurality of light emitters in the halo shaped pattern is output around the button.

6. The combination carbon monoxide and smoke detector of claim 1, further comprising a cover grille that allows air to enter the combination carbon monoxide and smoke detector.

7. The combination carbon monoxide and smoke detector of claim 1, wherein the reflector is circular.

8. The combination carbon monoxide and smoke detector of claim 7, wherein each of the plurality of light emitters is a group of light emitting diodes (LEDs).

9. The combination carbon monoxide and smoke detector of claim 1, wherein the plurality of the light emitters are illuminated to serve as a nightlight.

10. The combination carbon monoxide and smoke detector of claim 1, wherein the case further comprises a light transmission region, wherein the light transmission region of the case has an opacity that allows light emitted within the case to pass through material of the light transmission region, exit through a surface of the case, and cause the light transmission region to appear to glow.

11. A light distribution system for a sensor device, comprising:

a plurality of light emitters arranged in a circular pattern and mounted within a case of the sensor device;

a light guide comprising a light disperser that: is formed from a translucent or transparent material, is partially surrounded in reflective cladding, and that receives light from the plurality of light emitters and emits the light through a halo-shaped surface of the light disperser; and a reflector that reflects light emitted by the plurality of light emitters arranged in the circular pattern through the halo-shaped surface of the light guide into an ambient environment of the sensor device.

12. The light distribution system for the sensor device of claim 11, wherein the plurality of light emitters comprises at least six light emitters arranged in the circular pattern.

13. The light distribution system for the sensor device of claim 11, wherein the plurality of light emitters emit light in a plurality of colors.

14. The light distribution system for the sensor device of claim 13, wherein the plurality of light emitters emit light through the halo-shaped surface in the colors of red, green, and blue.

15. The light distribution system for the sensor device of claim 11, wherein the light emitted by the plurality of light emitters through the halo-shaped surface is output around a button.

16. The light distribution system for the sensor device of claim 11, further comprising a cover grille that allows air to enter the sensor device.

17. The light distribution system for the sensor device of claim 11, wherein the reflector is circular.

18. The light distribution system for the sensor device of claim 17, wherein each of the plurality of light emitters is a group of light emitting diodes (LEDs).

19. The light distribution system for the sensor device of claim 11, wherein the plurality of the light emitters are illuminated to serve as a nightlight.

20. The light distribution system for the sensor device of claim 11, wherein the case comprises a light transmission region, wherein the light transmission region of the case has an opacity that allows light emitted within the case to pass through material of the light transmission region, exit through a surface of the case, and cause the light transmission region to appear to glow.

* * * * *